United States Patent [19]

Maeno et al.

[11] Patent Number: 4,874,159

[45] Date of Patent: Oct. 17, 1989

[54] PAPER FEED DEVICE AND PAPER CASSETTE THEREFOR

[75] Inventors: Mikihiko Maeno; Yukio Ohta; Yoshiharu Momiyama; Hisao Ono; Katsumasa Takahata; Kazuyuki Ozono; Makoto Shimizu; Mikio Yamamoto, all of Tokyo, Japan

[73] Assignee: Oki Electric Industry Co., Ltd., Tokyo, Japan

[21] Appl. No.: 182,230

[22] Filed: Apr. 15, 1988

[30] Foreign Application Priority Data

| | | | |
|---|---|---|---|
| Apr. 16, 1987 | [JP] | Japan | 62-92029 |
| Apr. 16, 1987 | [JP] | Japan | 62-56711[U] |
| Apr. 17, 1987 | [JP] | Japan | 62-57534[U] |
| May 14, 1987 | [JP] | Japan | 62-70911[U] |
| May 28, 1987 | [JP] | Japan | 62-79873[U] |

[51] Int. Cl.[4] ..... B65H 1/12

[52] U.S. Cl. ..... 271/171; 271/126

[58] Field of Search ..... 271/126, 171, 145

[56] References Cited

U.S. PATENT DOCUMENTS

| | | | |
|---|---|---|---|
| 3,934,870 | 1/1976 | Miller et al. | 271/171 |
| 4,032,136 | 6/1977 | Komaba et al. | 271/171 |
| 4,569,587 | 2/1986 | Miyoshi et al. | 271/176 X |
| 4,697,803 | 10/1987 | Kan et al. | 271/171 |
| 4,780,740 | 10/1988 | Fukae | 271/171 |
| 4,786,042 | 11/1988 | Stemmle | 271/171 X |

FOREIGN PATENT DOCUMENTS

| | | | |
|---|---|---|---|
| 0084731 | 6/1980 | Japan | 271/171 |
| 218238 | 10/1985 | Japan . | |
| 173536 | 11/1985 | Japan . | |

*Primary Examiner*—Andres Kashnikow
*Assistant Examiner*—Matthew C. Graham
*Attorney, Agent, or Firm*—Koda & Androlia

[57] ABSTRACT

An automatic paper feed device is formed to store multiple types of different sized media in a single paper cassette and performs paper-feeding. A media load plate is loaded with said multiple types of different sized media. A media back edge guide assembly is mounted to a media load plate on which is loaded multiple types of different-sized media, to position the media loaded on the media load plate.

14 Claims, 28 Drawing Sheets

PAPER FEED DEVICE AND PAPER CASSETTE THEREFOR

BACKGROUND OF THE INVENTION

This invention relates to an automatic paper feed device which supplies cutforms and other media automatically to terminal devices such as printers.

A device to automatically supply media to terminal devices such as printers was disclosed in Japanese Patent Application Laid-open No. 218238/1985. When different sized media are supplied with this type of device, there are conventionally different hoppers or paper cassettes for each size of media. Media are stored in and supplied from these hoppers.

The following is an explanation of the conventional automatic paper feed device based on the drawings. FIG. 1 is a partially cut-away side view showing the conventional paper feed device.

Media 2 is stacked and stored in hopper or cassette 3, which is installed in automatic paper feed device 1. Printer 4 is placed on top of automatic paper feed device 1. Supply roller 5 is installed above cassette 3 and feed roller 6 is also disposed inside the device. Moreover, spring 7 is provided underneath media 2, cassette container 9 is installed to the side of automatic paper feed device 1 and printer 4. Cassette container 9 contains cassettes 8 which store specific sizes of media which are not in use.

The operation of the conventional automatic paper feed device will be explained next. The media 2 which is stacked and stored in cassette 3 is pushed by spring 7 into contact with supply roller 5. Supply roller 5 is rotated in the direction of arrow G by a drive means not shown, and this causes the media to begin to be fed from the top, one sheet at a time. Media 2, which has begun to be fed, is sent to printer 4 by feed roller 6.

When one wishes to print media which is different in size from media 2 (stacked and stored in cassette 3) with printer 4, one takes cassette 3 out of automatic paper feed device 1. Cassette 8, in which is stored the media of the size desired, is then taken out of cassette container 9 and installed in automatic paper feed device 1. Paper feed to printer 4 may then be performed. Cassette 3, which has been taken out of automatic paper feed device 1 is then stored in cassette container 9. By manual input instructions are sent to printer 4 concerning the size of the media newly installed in automatic paper feed device 1.

However, different cassettes for respective sizes of media are necessary in devices constructed as above. Also, since the automatic paper feed device permits mounting of only one cassette a separate place or container for the multiple cassettes storing media not in use are needed. Because of this, cassettes not being used must be placed in the immediate vicinity of the automatic paper feed device and the amount of space needed for the installation of the device is a problem.

The automatic paper feed device described above also has the fault of requiring a number of cassettes in which specific sizes of media are stored. Because of this cassette container must be provided and this increases the number of structural parts, and raises the price of the automatic paper feed device.

Furthermore, because the operator must send instructions to the printer concerning the size of the media it is easy for errors to occur. When errors occur it is necessary to reprint, and this is a problem because media is wasted.

Another problem associated with the prior art is that the media is pushed against the hopping roller and paper feed is accomplished by the same coil springs always pushing up the media load plate. But because the weight of the media stored in the paper cassette varies according to its size, the pressure by which the top of the media is pushed against the hopping roller varies.

Therefore too great a pressure will be obtained when feeding smaller media if springs whose pressure is appropriate to larger media are used. This will increase the occurrence of multiple feeding, in which 2 or 3 sheets are fed at the same time. When springs appropriate to smaller media are used, the pressure obtained will be too little for larger media and feed misses, in which the media is not fed, will occur more often.

SUMMARY OF THE INVENTION

An object of this invention is to solve the problems described above, making it possible for the installation area to be smaller and providing an inexpensive automatic paper feed device of excellent operability.

Another object of this invention is to provide a paper cassette from which can be obtained a pressure appropriate to the size of the media in question, and which is able thereby to feed media with stability.

According to one aspect of the invention there is provided an automatic paper feed device which stores multiple types of different size media in a single paper cassette and performs paper feed, and is comprised of a media load plate on which is loaded the multiple types of different sized media described above, a media back edge guide assembly which is mounted to said media load plate in such a way that it can be both moved and engaged and which positions the media loaded on said media load plate according to their individual sizes, a detection lever which is mounted on the bottom plate of said paper cassette in such a way that it can rotate, an engaging means which rotates said detection lever to accompany the movement of said media back edge guide assembly, a releasable maintaining means which maintains the position of said detection lever in accordance with the position at which said media back edge guide assembly stops, and a detection means which outputs an electric signal for each position at which said detection lever is maintained by said maintaining means.

With the structure described above, the paper cassette is first pulled outside of the body of the automatic paper feed device. Next, the media load plate inside the paper cassette is rotated to a specified direction and lowered. At this time the maintaining means, which maintains the position of the detection lever, is released. Next, the media is stored on the media load plate and the media back edge guide assembly is moved in response to the size of the media. The media back edge guide assembly is engaged at a position corresponding to the size of the media, and the media is positioned. The detection lever, which is engaged with the media back edge guide assembly by the engaging means, is rotated to accompany its movement. In the above-mentioned position to which it was rotated the detection lever operates the detection means and detects the size of the media.

According to another aspect of the invention, there is provided a paper cassette which stores media on a media load plate, said media load plate being journalled at one end so that it is able to rotate and being raised and lowered by moving the other end, and which performs paper feed by pushing up said other end of the media load plate with a spring thereby pressing the top of the media against a hopping roller, comprising a guide bracket attached to said media load plate and possessing multiple first stopping means in positions corresponding to the length in the media delivery direction of multiple types of media, and a media back edge guide assembly which is able to move in the delivery direction of the media, which possesses a second stopping means which engages to one of said first stopping means, and which is positioned according to the various sizes of a number of types of media.

When a media is stored in the paper cassette the media load plate is lowered. The media is loaded on top of the media load plate. The media back edge guide assembly is moved to the length of the media in the delivery direction. The first stopping means, provided on the guide bracket, and the second stopping means, provided on the media back edge guide assembly, engage at a position corresponding to the length of the media and the media back edge guide assembly is held in this position. This positions the media in the direction of delivery. According a further aspect of the invention, there is provided a paper cassette for an automatic feed device comprising a media back edge guide assembly made up of a movable member on which is installed a guide plate which positions the back edge of the media and an engagement member which abuts said guide plate in the media delivery direction, and a fixed member on which are provided an engagement sections which engage with the engaging member at positions which correspond to the lengths of the media in the direction of media delivery and a groove which connects the engagement sections, the media back edge guide assembly being provided on the media load plate, with the movable member being able to slide back and forth in the direction of media delivery in regards to the fixed member.

The movable member of the media back edge guide assembly installed on the paper cassette according to the length of the media loaded is caused to slide in relation to the fixed member and by engaging the engagement member attached to the movable member, with the engagement section, which is provided on the fixed section corresponding to the length of the media, it is possible to position the front edge of the media in the direction of media delivery at a set point in relation to the main body.

According to a further aspect of the invention, there is provided a paper cassette which stores a number of types of media on a media load plate, one end of which is journalled (rotatably supported) in such a way that it is able to rotate and the other end of which is rotated up and down by a reset arm, and performs paper feed with the media pushed against a hopping roller by a spring which pushes the media load plate upwards, comprising an auxiliary resilient member which pushes the reset arm up, and a sub-arm, one end of which abuts and stops said auxiliary resilient member and which rotates together with the auxiliary resilient member, and a means provided in the rotation range of said sub-arm for regulating the rotation of said sub-arm according to the size of the media by being able to move in accordance with the size of media.

When the paper cassette stores a large media the media load plate is raised by a reset arm and this causes a sub-arm to rotate following the reset arm. This in turn causes an auxiliary resilient member to push up the reset arm and media load plate. The pressure by which the media is pushed against the hopping roller is therefore the combined upward pushing force of the coil springs and the auxiliary resilient member.

When a smaller media is stored, the sub-arm is prevented from rotating even though the media load plate is pushed up by the reset arm. Therefore, because the auxiliary resilient member is separated from the reset arm, the upward pushing force of the auxiliary resilient member is not transmitted to the media load plate. The pressure pushing the media against the hopping roller is therefore only the upward pushing force of the coil springs.

According to a further aspect of the invention, there is provided a paper cassette which stores a number of types of media on a media load plate, one end of which is journalled in such a way that it is able to rotate and the other end of which is rotated up and down by a reset arm, and which positions the width of the media by moving a side plate, and which performs paper feed with the media pushed against a hopping roller by a spring which pushes said other end of the media load plate upwards, comprising an auxiliary resilient member which rotates following said reset arm and pushes the reset arm up, and a means, formed integrally with the side plate, which regulates the rotation of said auxiliary arm by moving in accordance with the size of the media.

When the paper cassette stores a large media the media load plate is raised by a reset arm and this causes an auxiliary resilient member to rotate following the reset arm. This in turn causes the auxiliary resilient member to push up the reset arm and media load plate. The pressure by which the media is pushed against the hopping roller is therefore the combined upward pushing force of the coil springs and the auxiliary resilient member.

When a smaller media is stored, the auxiliary resilient member does not rotate even though the media load plate is pushed up by the reset arm. Therefore, the upward pushing force of the auxiliary resilient member is not transmitted to the reset arm media load plate. The pressure pushing the media against the hopping roller is therefore only the upward pushing force of the coil springs.

DETAILED DESCRIPTION OF THE PREFERRED EMBODIMENTS

The following is an explanation of embodiment according to this invention following the drawings. The same numbers will be given to common elements in each drawing.

Figure 1:
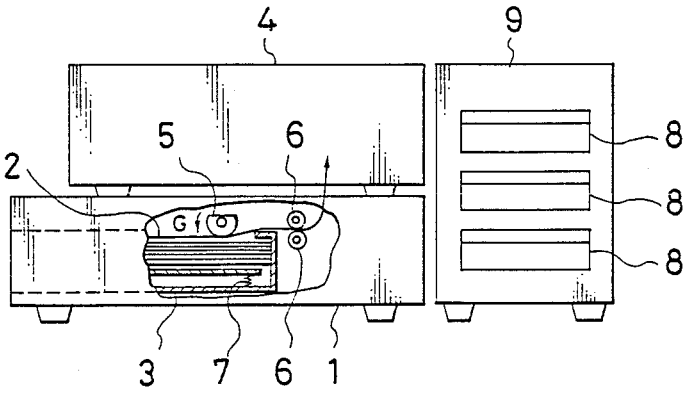
FIG. 1 PRIOR ART
FIG. 1 is a partial cut-away side view showing the conventional automatic paper feed device.
Figure 2:
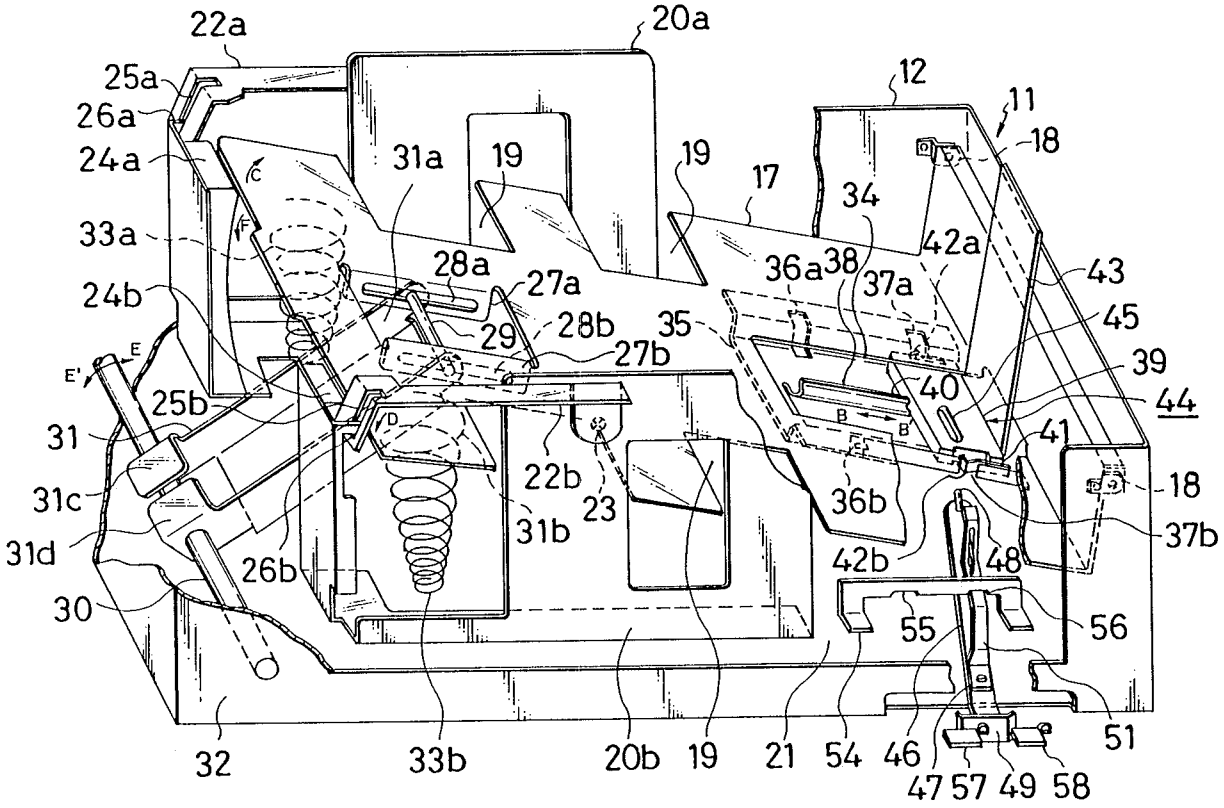
FIG. 2 is a partial cut-away perspective view showing a first embodiment of an automatic paper feed device according to this invention.
Figure 3:
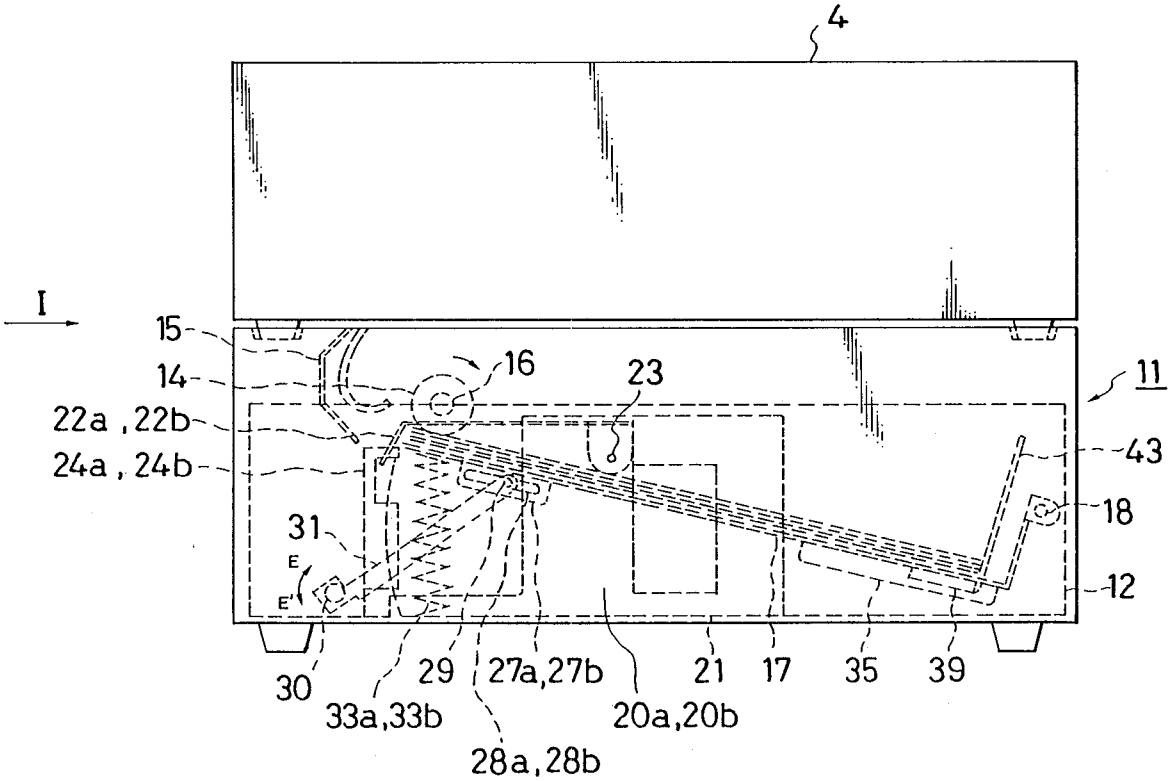
FIG. 3 is a front view showing an automatic paper feed device according to this invention and a printer.
Figure 4:
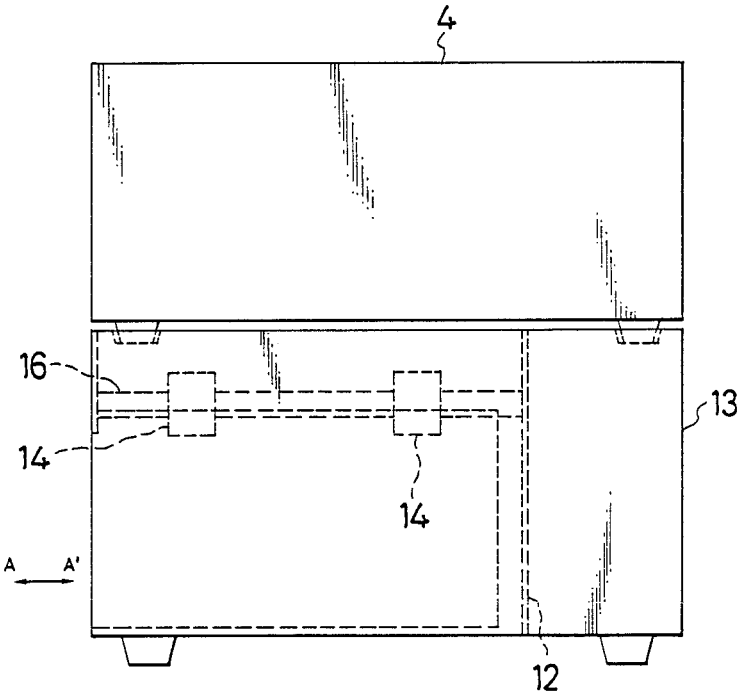
FIG. 4 is a side view of FIG. 3 seen from the direction shown by arrow I.

First, the structure of a first embodiment of an automatic paper feed device according to this invention will be explained. FIG. 2 is a partially cut-away side view showing a first embodiment of an automatic paper feed device according to this invention. FIG. 3 is a front view showing an automatic paper feed device and printer according to this invention. FIG. 4 is a side view looking in the direction of arrow in FIG. 3.

In FIG. 3 and FIG. 4 printer 4 is placed on top of automatic paper feed device 11. Automatic paper feed device 11 is comprised of hopper or paper cassette 12 and frame 13. Hopping roller 14 and media discharge guide 15 are installed in the top part of paper cassette 12. Hopping roller 14 is rotated through shaft 16 by a motor (not shown) mounted in frame 13 in the front part of and above paper cassette 12. Also, it is so arranged that paper cassette 12 can be pulled out of automatic paper feed device 11 in the direction shown by arrow A in FIG. 4.

The following explains in detail the internal structure of paper cassette 12 referring to FIG. 2 and FIG. 3. L-shaped media load plate 17 is attached to paper cassette 12 so that it is able to rotate about point 18 relative to cassette frame 12. In this embodiment the left side of media load plate 17, as shown in FIG. 3, shall be considered the front and the right side shall be considered the back. Cutouts 19 are provided on both sides of media load plate 17. A pair of side plates **20*a* and 20*b* are disposed to face each other on bottom plate 21 of cassette 12 with media load plate 17 between them. They are furthermore engaged with cutouts 19 of media load plate 17 and are mounted so that it is possible for them to slide to move toward and away from each other for adjustment to the width of the media. Side plates 20*a* and 20*b* are thus used to regulate the position of the media in the width direction. Guide blocks 24*a* and 24*b* respectively are also attached to the fronts of side plates 20 by screw to regulate the position of the front edge of media. Media separation claws 22*a* and 22*b* respectively are attached to the tops of side plates 20 by screw 23 so that it is possible for them to rotate. Media separations claws 22*a* and 22*b* separate media into single sheets. Furthermore slits 25*a* and 25*b* are provided at one ends of separation claws 22*a* and 22*b* respectively. Slits 25*a* and 25*b* and protrusions 26*a* and 26*b* of guide blocks 24*a* and 24*b* are respectively engaged. Separation claws 22*a* and 22*b* can rotate about fulcrum 23**.

A pair of flanges **27*a* and 27*b* are formed in the lower front area of media load plate 17. Flanges 27*a* and 27*b* extend downward at right angles with meadia load plate 12. Oval holes 28*a* and 28*b* are provided on the pair of flanges 27*a* and 27*b* respectively. Oval holes 28*a* and 28*b* are parallel with each other. Slidably extending throught oval holes 28*a* and 28*b* is shaft 29. On both ends of shaft 29 reset arm 31 is attached. Reset arm 31 is attached to and supported by shaft 30. Shaft 30 is supported by cassette frame 32. A pair of coil springs 33*a* and 33*b* are provided between the left and right of the front bottom of media load plate 12 and bottom plate of paper cassette 12. Springs 33*a* and 33*b* push media load plate 17** up.

Square hole or cutout 34 is provided in the back of media load plate 17. Guide bracket 35 is attached so that it covers cutout 34 from the bottom. On the left and right of guide bracket 35 are provided two pairs of slits 36*a* and 36*b*, and 37*a* and 37*b*. Guide rail 38 is formed integrally with guide bracket 35 and is formed to extend in the direction of delivery of media substantially in the center of bracket 35. Slide block 39 is attached between media load plate 17 and guide bracket 35. Groove 40 is provided substantially in the center of slide block 39 and mates with guide rail 38 so that slide block 39 can slide in the direction shown by arrow B in FIG. 2. Plate springs 41 are attached to the side faces of slide block 39. Plate spring 41 possess convex area 42*a* and 42*b* on either side of slide block 39 and are given bias force. Guide plate 43 is also attached to slide block 39. Guide plate 43 possesses a face perpendicular to the direction in which slide block 39 slides. The media back edge guide assembly 44 is composed of the above-mentioned slide block 39, plate spring 41 and guide plate 43.

The convex sections 42*a* and 42*b* of plate springs 41 are constructed so that it is possible for them to fit into slits 36*a* and 36*b*, as well as 37*a* and 37*b* of guide bracket 35. The pairs of slits 36*a* and 36*b*, and 37*a* and 37*b* are disposed at positions corresponding to lengths of the respective types of media. When convex sections 42*a* and 42*b* are in a state in which they fit into slits 36*a* and 36*b*, as well as 37*a* and 37*b*, media back edge guide assembly 44 is stopped by the bias force of plate springs 41. However, it is possible to move media back edge guide assembly 44 manually. Also, the positions in which convex sections 42*a* and 42*b* of plate springs 41 fit into slits 36*a* and 36*b*, 37*a* and 37*b* of guide bracket 35 are set as the positions in which the distances between guide plate 43 and the tip of media load plate 17 may become lengths of established forms such as A4 or B5.

Oval hole 45 is provided on slide block 39. Its direction of length is perpendicular to the slide direction. Also, detection lever 46 is attached to bottom plate 21 of cassette 12 so that it is able to rotate with fulcrum 47 as its center. Pilot pin 48 is attached to one end of detection lever 46. It is possible for pilot pin 48 to fit into oval hole 45 of slide block 39. On the other end of detection lever 46 is flat area 49.

Figure 5:
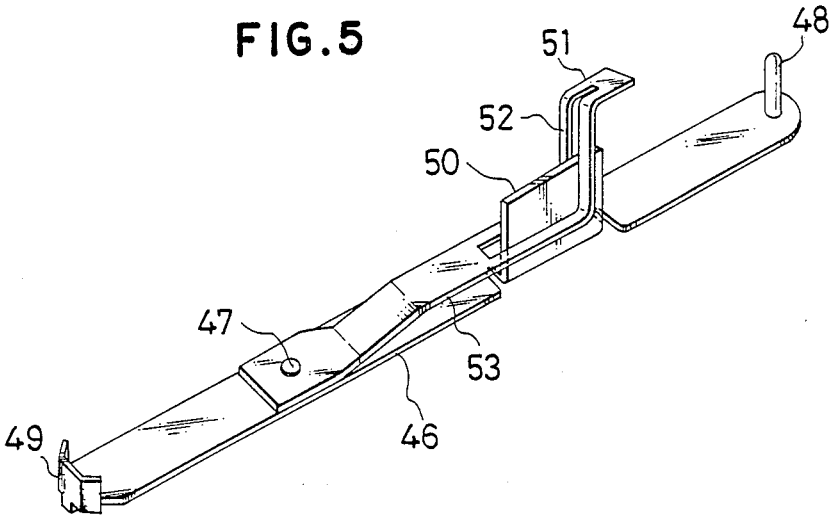
FIG. 5 is a perspective view showing the detection lever for the first embodiment according to this invention.

The following is a detailed explanation of detection lever 46 with reference to FIG. 5. FIG. 5 is a perspective view showing a detection lever according to the first embodiment of this invention.

Flat wall 50 is formed on detection lever 46. Sub-lever 51 is fixed to detection lever 46. Both sub-lever 51 and detection lever 46 are able to be attached to bottom plate 21 of cassette 12 at fulcrum 47. Flat wall 50 fits into slit 52 which is provided on sub-lever 51. The structure is such that the rotation of sub-lever 51 accompanies the rotation of detection lever 46. Sub-lever 51 is formed of a resilient member which may be distorted upwards and downwards, and possesses a horizontal area in its center.

In FIG. 2 maintaining plates 54 are attached to bottom plate 21 of cassette 12 in such a way that they straddle detection lever 46 and sub-lever 51. As many concave sections 55 and 56 are formed on maintaining plates 54 as there are pairs of slits 36*a* and 36*b*, 37*a* and 37*b* on guide bracket 35. They are a little wider than horizontal section 53 of sub-lever 51. The height of pilot pin 48 of detection lever 46 and the attachment of maintaining plate 54 from bottom plate 21 of concave sections 55 and 56 are set relatively so that horizontal section 53 of sub-lever 51 is engaged with concave sections 55 and 56 of maintaining plate 54 before pilot pin 48 leaves oval hole 45 of slide block 39.

A number of microswitches 57 and 58 are disposed in positions where they come in contact with flat section 49 of detection lever 46. These microswitches 57 and 58 are attached to the side frame 13, as shown in FIG. 4. Their number corresponds to that of concave sections 55 and 56 of maintaining plate 54 described above. Slits 36*a* and 36*b*, 37*a* and 37*b*, concave areas 55 and 56, and microswitches 57 and 58 are aligned with each other. The media size detection mechanism 59 is composed of these oval holes 45, detection lever 46, sub-lever 51, maintaining plate 54 and microswitches 57 and 58.

Figure 6:
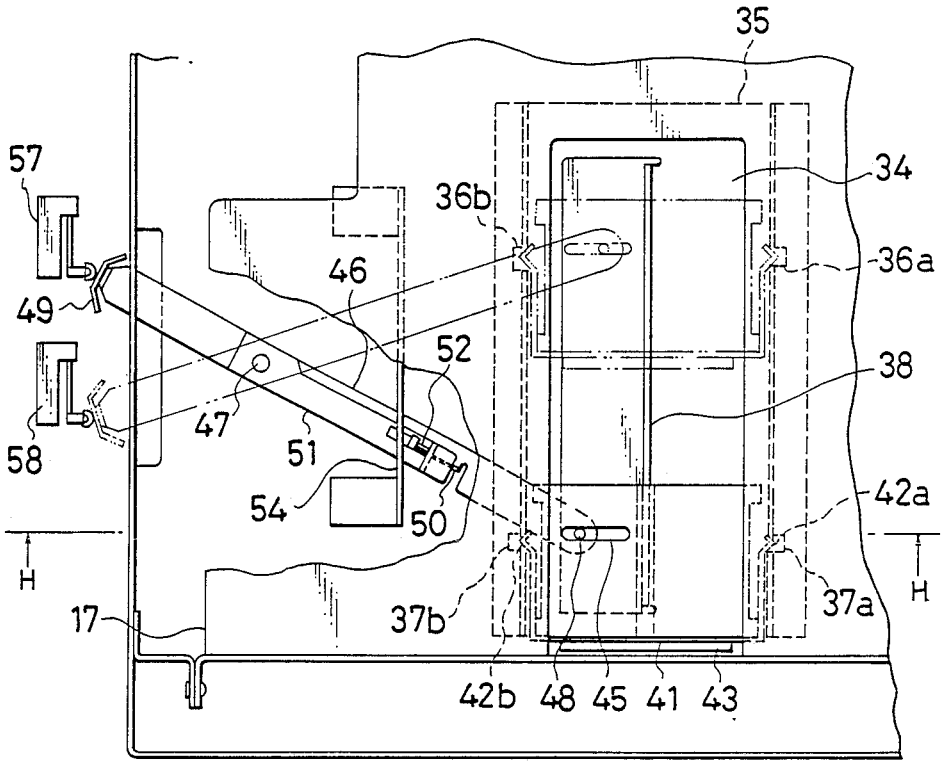
FIG. 6 is a partial cut-away plan view showing the second embodiment of a media size detection mechanism according to this invention.
Figure 7:
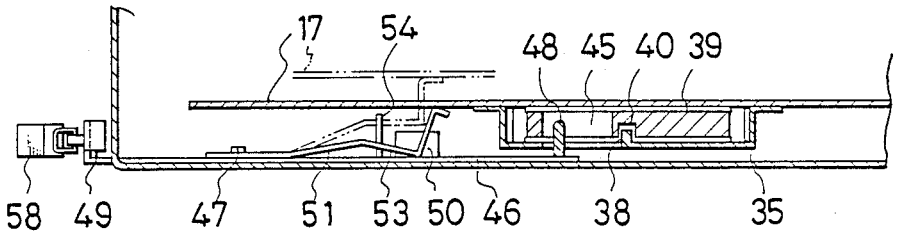
FIG. 7 is an H—H cross sectional view of FIG. 6.

Next, the operation will be further explained with reference to FIG. 6 and FIG. 7. FIG. 6 is a partially cut-away plan view showing the operation of the media size detection mechanism of the first embodiment of this invention. FIG. 7 is a H—H cross section in FIG. 6.

In order to set media, hopper 12 must be pulled out of device 11. In preparation therefor, shaft 30 is rotated in the direction E by lever, not shown. Then media load plate 17 is lowered by rotation in the direction F, via reset arm 31, shaft 29 and flanges 27*a*, 27*b*. At this time, separation claims 22*a*, 22*b* fall, due to gravity, rotating about pivot axis 23, until the upper extermities of slits 25*a*, 25*b* abut protrusions 26*a*, 26*b* of guide block 24*a*, 24*b*. In this state, hopper 12 can be pulled out of device in the direction A without interference between hopping roller 14 and media load plate 17, or separation claws 22*a*, 22*b*.

Pilot pin 48 of detection lever 46 fits into oval hole 45 of slide block 39 with the dropping-down of media load plate 17. At the same time sub-lever 51 attached to detection lever 46 is energized in a downward direction, as shown by the solid line in FIG. 7. At this time horizontal section 53 of sub-lever 51 is released from concave section 56 of maintaining plate 54.

The following is an explanation of the storage and feeding of a small sized media in cassette 12 after it has been pulled out. First, media back edge guide assembly 44 is moved manually in the direction shown by arrow B in FIG. 2. Convex sections 42*a* and 42*b* of plate spring 41 are released from slits 37*a* and 37*b* of guide bracket 35. They then slide on the side face of guide bracket 35 and fit into slits 36*a* and 36*b*, which correspond to the length of media 2. Media back edge guide assembly 44 is stopped in this position. Because a bias force is applied to convex sections 42*a* and 42*b* of plate spring 41 media back edge guide assembly 44 is stopped and held in the position in which they have been inserted into slits 36*a* and 36*b*. This positions media 2 in the delivery direction.

Along with the movement of media back edge guide assembly 44, detection lever 46 rotates with fulcrum 47 as its center from the position shown by the solid lines in FIG. 6 to the position shown by the phantom lines. This rotation accompanies the movement of media back edge guide assembly 44. At this point media 2 is set on media load plate 17. Because the distance between the tip of media load plate 17 and guide plate 43 is equivalent to the length of one side of media 2, the media is positioned in such a way that it will not slip. In this state, the front of media 2 is in abutment with guide blocks 24*a* and 24*b*.

Next, side plates 20*a* and 20*b* are moved to the width of media 2. Paper cassette 12 can be pushed back into device 11 in this state. When paper cassette 12 is pushed into device 11, flat area 49 attached to detection layer 46 comes in contact with corresponding microswitch 58 corresponding to small-sized media and attached to the inside of frame 13, and this activates microswitch 58. In this way the size of media 2 set is detected and printer 4 is informed of the size of media 2.

After cassette 12 is pushed back into device 11, shaft 30 is rotated in a direction shown by arrow E' by a lever not shown in the drawings. When this happens, by the action of a pair of coil springs 33*a* and 33*b* attached to the bottom front of media load plate 17, media load plate 17 is rotated in the direction shown by arrow C with fulcrum 18 as its center. The very top of media 2, loaded onto media load plate 17, is pushed into contact with hopping roller 14. Also, separation claws 22*a* and 22*b* are pushed up by media 2 at this time, and are stopped by protrusions 26*a* and 26*b* of guide blocks 24*a* and 24*b*, respectively. Therefore, media 2 is able to be fed. By rotating hopping roller 14 in the clockwise direction as seen in FIG. 2, media 2 follows media feed path 15 and is sent to the printer one sheet at a time from the top.

When paper feed is continued, the number of sheets of media 2 inside cassette 12 becomes smaller. As this happens media load plate 17 is gradually pushed upwards by springs 33*a* and 33*b*. When media load plate 17 is pushed up, sub-lever 51, attached to detection lever 46, goes to the state shown by the phantom lines in FIG. 7 and horizontal section 53 is engaged with concave section 56 of maintaining plate 54.

Figure 8:
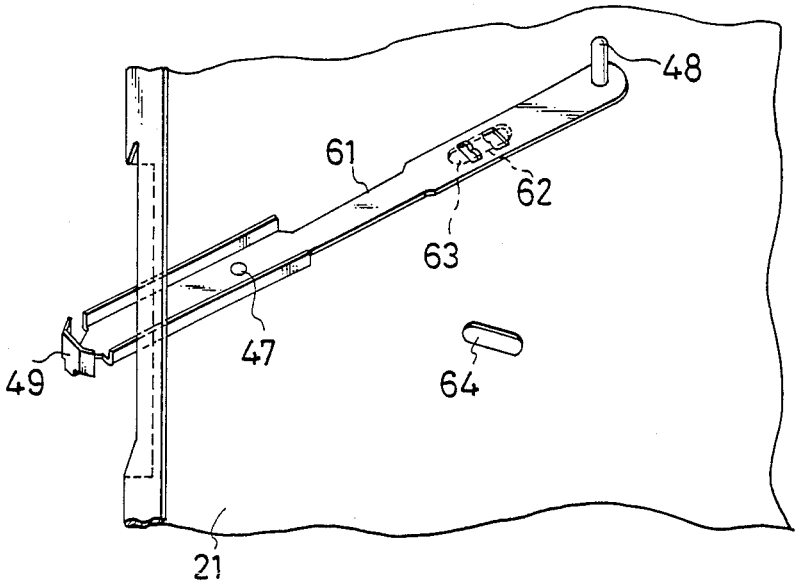
FIG. 8 is a perspective view showing a second embodiment of a detection lever according to this invention.

A second embodiment of a media size detection mechanism according to this invention will be explained with reference to FIG. 8.

Detection lever 61 is formed of a resilient material. It is attached to bottom plate 21 of hopper 12 in such a way that it is able to rotate freely on fulcrum 47. Pilot pin 48 is provided on one end of it, on the other is provided flat section 49. Convex section 62, which juts out to the side of bottom plate 21 of hopper 12, is also formed on detection lever 61. Apertures 63 and 64 are formed on the same circle on bottom plate 21 of cassette 12 as convex section 62, which has fulcrum 47 as its center. The positions of apertures 63 and 64 are set to that convex section 62 of detection lever 61 fits into aperture 63 or 64 when convex sections 42*a* or 42*b* of plate spring 41 of media back edge guide assembly 44 fit into slits 36*a* and 36*b*, or 37*a* and 37*b* of guide bracket 35.

When setting media 2 in cassette 12 in a media size detection mechanism as described above, media load plate 17 is first dropped down, causing oval hole 45 of slide block 39 and pilot pin 48 of detection lever 61 to fit. Moving slide block 39 to correspond with the type of media 2 causes an accompanying rotation of detection lever 61 with fulcrum 47 as center. Moving it to the form length of the media 2 set causes convex sections 62 of detection lever 61 to fit into aperture 63 or 64. Because detection lever 61 is formed of a resilient member which distorts upwards and downwards, an energizing force is applied in the direction of the bottom plate of cassette 12 and detection lever 61 is maintained in this state.

The same effects may be obtained when structuring the detection lever in this way as were obtained in the first embodiment. Also, because the sub-lever and maintaining plate are unnecessary this structure also has the effect of being even simpler in comparison to the first embodiment.

Figure 9:
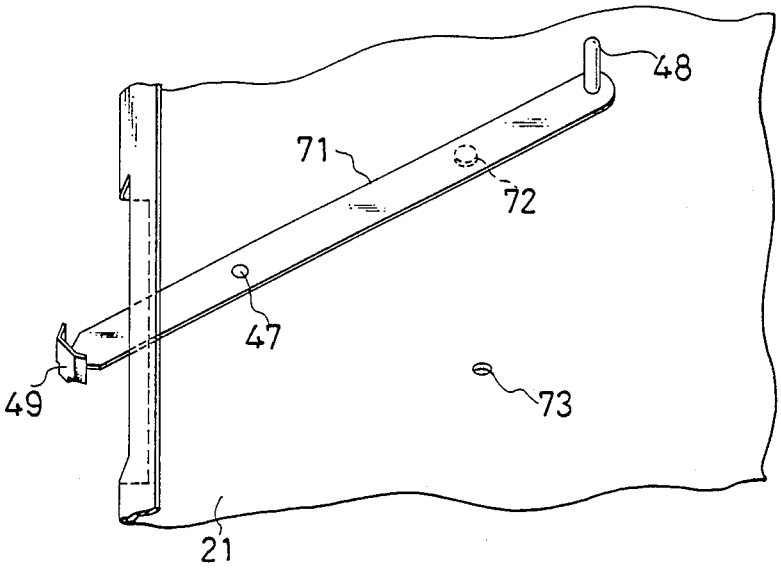
FIG. 9 is a perspective view showing a third embodiment of a detection lever according to this invention.

A third embodiment of a media size detection mechanism according to this invention will be explained referring to FIG. 9.

Detection lever 71 is formed of a magnetic material. It is attached to bottom plate 21 of cassette 12 in such a way that it is able to rotate freely with fulcrum 47 as center. Also, a number of magnets 72 and 73 are disposed at positions on bottom plate 21 of cassette 12 corresponding to the sizes of media. Because other aspects of its structure and operation are the same as the second embodiment their explanation will be foregone.

Structuring the mechanism as described above will allow the same effects to be obtained as were obtained in the first and second embodiments. This embodiment also has the effect of possessing an even simpler structure in comparison to the second embodiment.

For a maintaining means for the detection lever according to this invention, other than the embodiments described above, it is also possible to maintain the detection lever so that it is able to rotate manually during attachment adjustments but will not easily be moved by the vibration of the device etc. This would make the structure of the maintaining means even simpler.

A fourth embodiment of the media size detection mechanism is illustrated in FIG. 10 through FIG. 13.

This embodiment is characterized in that the detection mechanism comprises a slide piece mounted slidably on the bottom plate of the cassette to slide with the movement of the media back edge guide assembly, and detection levers responsive to the movement of the slide piece.

Figure 10:
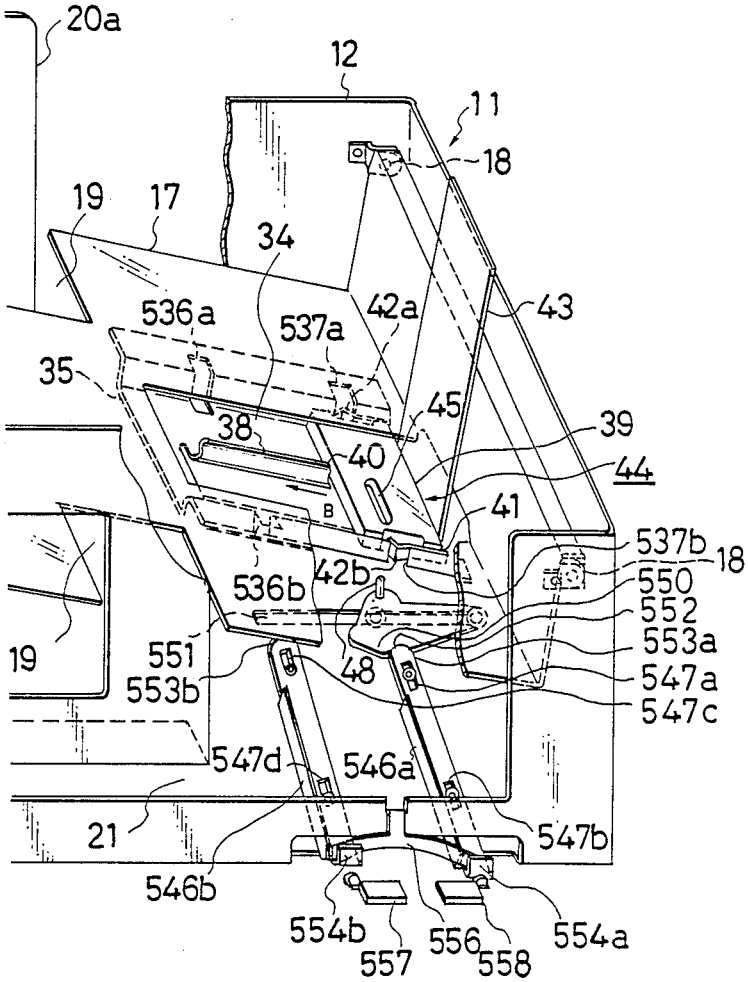
FIG. 10 is a partial cut-away perspective view showing a further embodiment of the detection mechanism.
Figure 11:
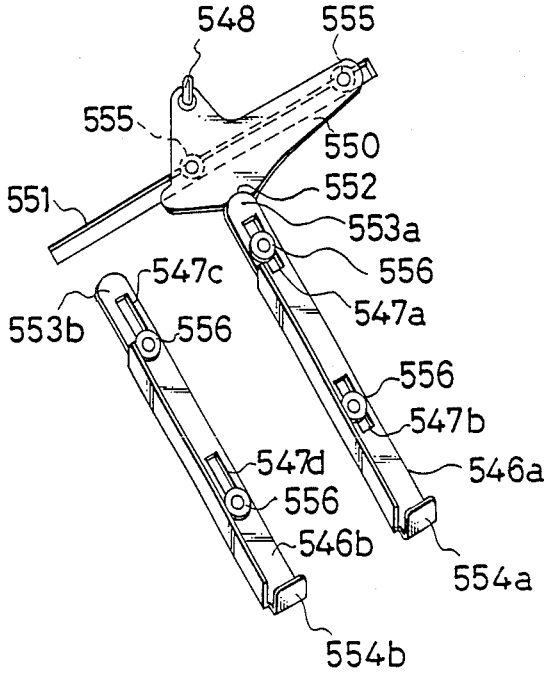
FIG. 11 is a perspective view showing a slide piece and detection levers forming a part of the detection mechanism shown in FIG. 10.
Figure 12:
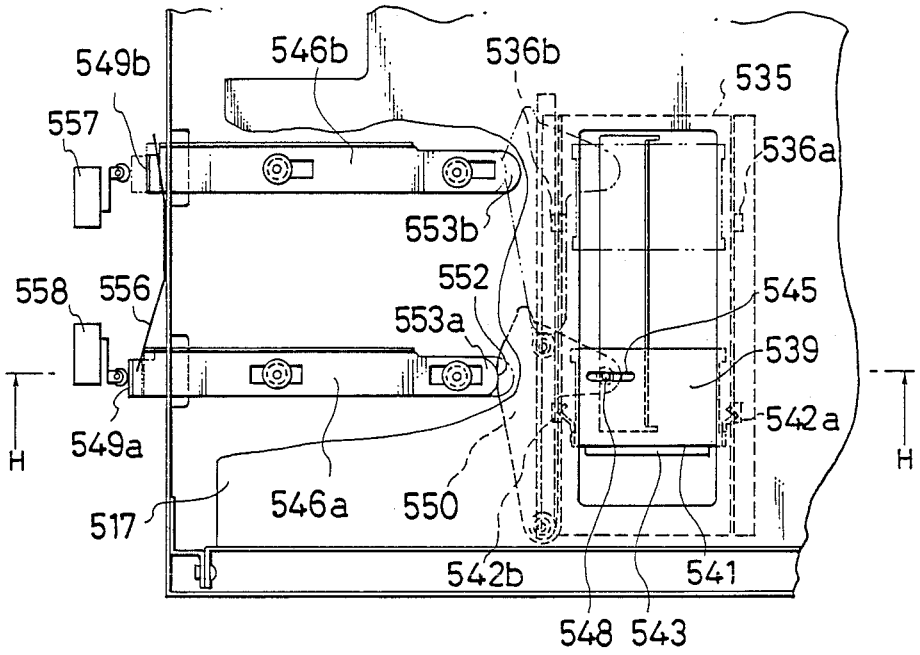
FIG. 12 is a partial cut-away view of showing the operation of media size detection mechanism of FIG. 10.
Figure 13:
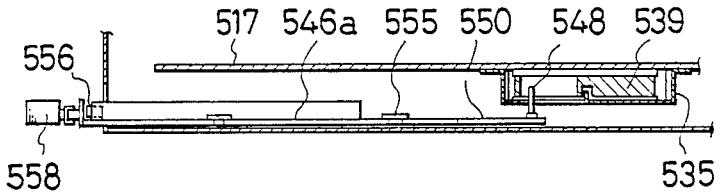
FIG. 13 is a cross section along line H—H in FIG. 12.

As illustrated in FIG. 10 and FIG. 11, the structure of this embodiment is similar to the embodiment of FIG. 2 through FIG. 6. The difference is as follows: Provided on bottom plate 21 of cassette 12 is a slide piece 550 slidably along groove 551. Slide piece 550 has two threaded holes and fixed by screw through collars 555 to grooves 551 of bottom plate 21. Detection levers 546*a* and 546*b* have elongated or rectangular holes 547*a* through 547*d* and are fixed by screw through collars 556 to bottom plate 21, so that they are slidable along elongated holes 547*a* through 547*d*. Provided on part of slide piece 550 is a pilot pin 548 engageable with oval hole 45 of slide block 39. Formed at another part of slide piece 550 is concave section 552. One ends 553*a* and 553*b* of detection levers 546*a* and 546*b* are rounded to be engageable with concave section 552. Formed at the other ends are flat parts 554*a* and 554*b*. Microswitches 557 and 558 are disposed at positions where flat end parts 554*a* and 554*b* of detection levers 546*a* and 546*b* abut with microswitches 557 and 558. Microswitches 557 and 558 are fixed to frame 13 and provided in number corresponding to the number of detection levers 546*a* and 546*b* so that they are respectively associated with detection levers 546*a* and 546*b*.

Detection levers 546*a* and 546*b*, slide piece 550 and microswitches 557 and 558 form media size detection mechanism 559 of this embodiment.

When media load plate 17 is lowered in the same way as in the first embodiment previously described, pilot pin 548 of the slide piece 550 engages with oval hole 45 of slide block 39.

Assume, for the purpose of explanation, the situation in which the small-sized media is stored in and fed from cassette 12. When media back edge guide assembly 44 is moved, slide piece 550 also moves and slide piece 550 and detection lever 546*a* are disengaged and by action of plate spring 556 and moves from the position indicated by solid line to the position indicated by phantom line.

Rounded end part 553b of the other detection lever 546b becomes engaged with concave section 552 of slide piece 550 so that detection lever 546b moves from the position indicated by solid line to the position indicated by phantom line.

Flat part 549b of detection lever 546b abuts with microswitch 557 to actuate microswitch 557. An electrical signal indicating the size of the media loaded is thereby produced.

The configurations of the embodiments described above allow a number of types of media to be stored and fed from a single cassette, removing the necessity of providing a different cassette for each type of media. Therefore, less installment space is required and the device can be provided at a lower cost.

Also, because it is possible for the media back edge guide assembly to move and stop in relation to the media load plate, it is possible to position all different sized media and perform stable media feeding.

Also, because the size of the media set in the cassette is automatically detected, there are no operation errors by the operator and waste of media is therefore reduced.

Figure 14:
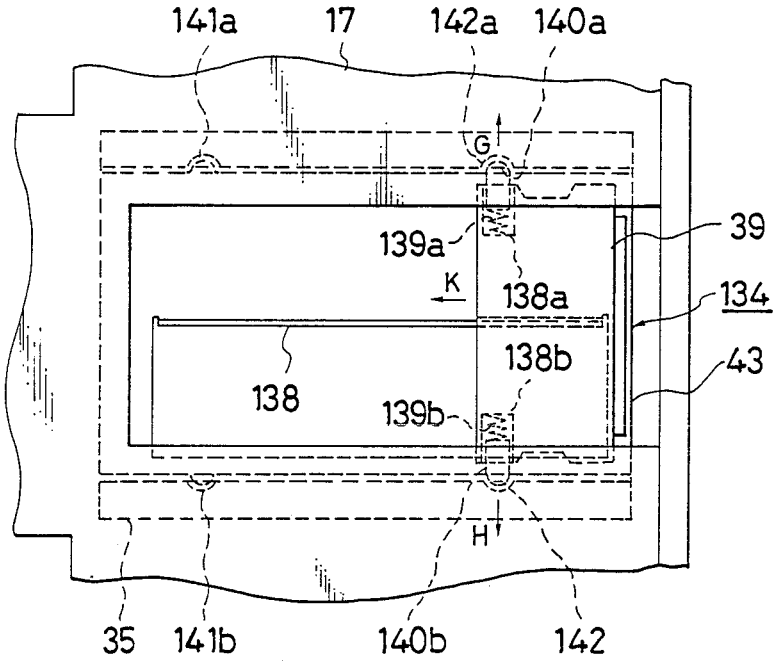
FIG. 14 is a top view of part of another embodiment of this invention.

A fifth embodiment of this invention will be explained next with reference to FIG. 14.

In this embodiment, a pair of cutout holes 138a and 138b are formed on slide block 39. Coil springs 139a and 139b are inserted into cutout holes 138a and 138b respectively and protruding members 140a and 140b respectively are inserted into the outside of the coil springs 139a and 139b, resisting the bias force of coil springs 139a and 139b. Therefore bias force is applied to protruding members 140a and 140b in the directions of arrows G and H respectively. Also, on guide bracket 35 are formed pairs of concave sections 141a and 141b, and 142a and 142b corresponding to the sizes of a number of (two, in the example illustrated) different media. The remaining structure is the same as that of the embodiment described with reference to FIG. 2 through FIG. 7.

In a structure like the one described above, media back edge guide assembly 44 is moved manually in order to position the media loaded on media load plate 17 in the delivery direction. Protruding members 140a and 140b resist the bias force of coil springs 139a and 139b and are pushed back from the slant faces of concave sections 142a and 142b of guide bracket 35. Protruding members 140a and 140b come out of concave sections 142a and 142b and slide along the sides of guide bracket 35, and then inserted into concave sections 141a and 141b and held by the bias force of coil springs 139a and 139b.

The same effects can be obtained from the embodiment constructed as described above as were obtained from the embodiment described with reference to FIG. 2 through FIG. 7.

In the above embodiment protruding members having a bias force were provided on the slide block and concave sections were provided at specific positions on the guide bracket. It is also possible for there to be concave sections on the slide block and a number of protruding members at specified positions on the sides of the guide bracket which would engage the concave sections and possess a bias force.

Furthermore, in the embodiment described above engagement means (combinations of concave sections, protruding members and springs) were provided on both sides of the slide block to stop the media back edge guide assembly. It is also possible for the stopping means to be provided on one side only if sufficient stopping power can be obtained.

Figure 15:
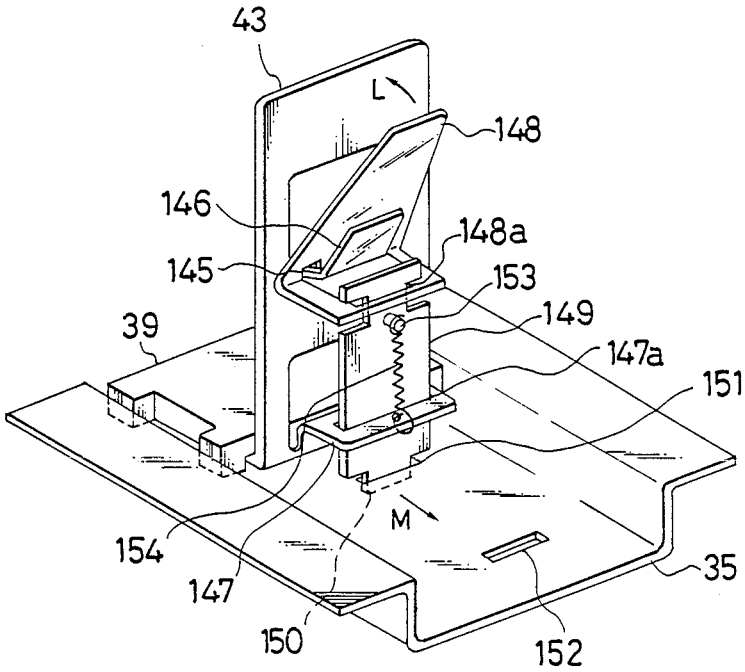
FIG. 15 is a back perspective view of the media back edge guide assembly of a further embodiment according to this invention.

A sixth embodiment according to this invention will be explained referring to FIG. 15.

On bracket 35 are provided a number of rectangular holes 151 and 152 in positions corresponding to the sizes of a number of different media. On guide bracket 43 are provided bracket section 146, which possesses a horizontal section and is formed integrally in an L shape, and bracket section 147, which is formed integrally perpendicular to the face of guide plate 43 and possess rectangular hole 147a. Arm 148 is attached so that it is able to rotate with the top face of horizontal section 145 of bracket section 146 as its fulcrum. Rectangular hole 148a is formed on arm 148. The constricted section of plate 149 is inserted into rectangular hole 148a of arm 148 and, passing through rectangular hole 147a. Tip 150 is inserted into rectangular hole 151 of guide bracket 35. Post 153 is also attached to plate 149, and spring 154 is stretched between post 153 and bracket section 147. Therefore, plate 149 is energized downwards by spring 154.

When the guide assembly 144 of the above embodiment is moved in response to the size of a media, the tops of guide plate 43 and arm 148 are held in one's hand and arm 148 is rotated in the direction of arrow L, pulling up plate 149. This causes tip 150 of plate 149 to come out of rectangular hole 151 of guide bracket 35. Media back edge guide assembly 44 is now in a state in which it is able to move. When, for example, a larger media is to be used, it is moved in the direction of arrow M. When plate 149 is above rectangular hole 152 one releases one's grip. The energizing force from spring 154 causes plate 149 to move downwards and tip 150 is inserted into rectangular hole 152. This holds media back edge guide assembly in place and positions it in the direction of media delivery.

The same effects may be obtained from the embodiment constructed as described above, as were obtained from the embodiments described earlier. Furthermore, because in the above embodiment the tip of the plate is inserted into a rectangular hole the positioning of the media is more certain.

Figure 16:
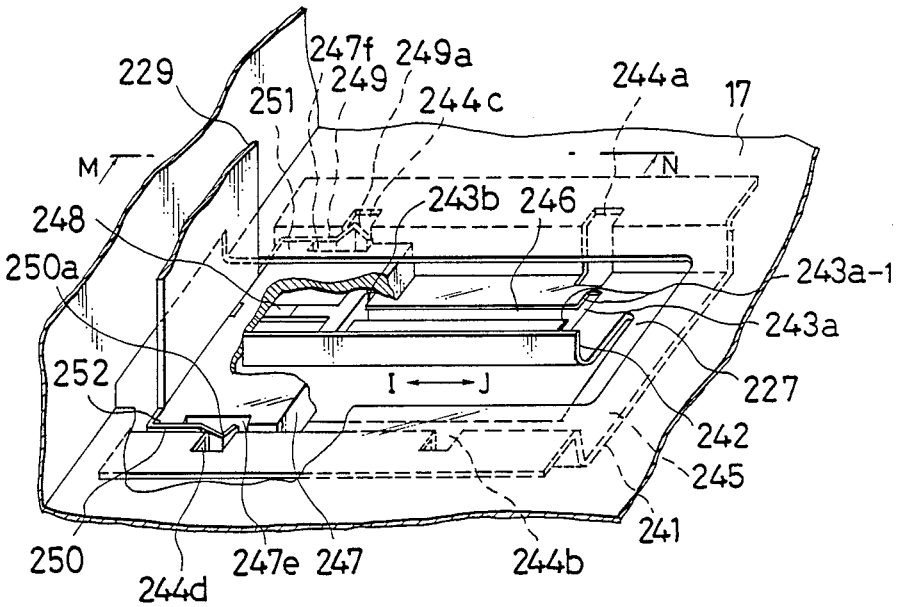
FIG. 16 is an enlarged view of another embodiment of the media back edge guide assembly.
Figure 17:
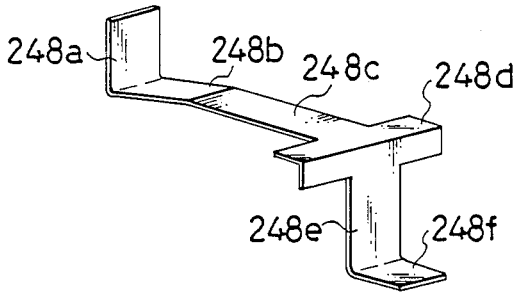
FIG. 17 is an external perspective view of the primary engagement member.

FIG. 16 through FIG. 20 show another embodiment of media back edge guide assembly 228 which includes, as a fixed member, guide bracket 241, which is formed so that a cross section of it contains a depression and which is fixed on the back face of media load plate 17 around square hole 34 as shown in FIG. 16. On guide bracket 241 are provided guide rail 242 and primary slits 243a and 243b which are in positions corresponding to the lengths of the two types of media. Also provided on guide bracket 241 are secondary slits 244a and 244b, which are in positions corresponding to primary slit 243a, and secondary slits 244c and 244d, which are in positions corresponding to primary slit 243b. Guide rail 242 is section of bottom 245 of guide bracket 241 which has been cut and turned up so that it is perpendicular to bottom 245 and parallel to the direction of media delivery. Primary slits 243a and 243b are on bottom 245 of guide bracket 241, and their lengths are perpendicular to the direction of media delivery. The slits are connected by groove 246 which has a width narrower than that of the slits. Secondary slits 244a, 244b, 244c and 244d also have their lengths perpendicular to the direction of media delivery and are on the sides of guide bracket 241. Slide block 247 is a movable member which slides along guide rail 242 of guide bracket 241 in the directions shown by arrow I-J. Guide plate 229, primary engagement member 248 and secondary engagement members 249 and 250 are installed on slide block 247. As shown in FIG. 20A and FIG. 20B, on slide block 247 are provided: guide groove 247*a*, which is engaged with guide rail 242 of guide bracket 241; groove 247*b*, to which is attached primary engagement member 248; clearance groove 247*f* for secondary engagement member 249; and clearance groove 247*e* for secondary engagement member 250. Groove 247*b* becomes slant as indicated by reference 247*d* after specified area 247*c*. Primary engagement member 248 is made from a plate spring and its outline is substantially L-shaped, as shown in FIG. 17. On one end of primary engagement member 248 is fixing section 248*a*, in between side face 247*g* of slide block 247 and guide plate 229, and fastened to slide block 247 together with guide plate 229 by a screw not shown. Leg 248*f* is provided on the other end of primary engagement member 248. In the interior of the substantially right-angle area formed between fixing section 248*a* and leg 248*f* is provided hook 248*d*, which is wide. Bridge 248*c* is between fixing section 248*a* and hook 248*d*, and bridge 248*e* is between hook 248*d* and leg 248*f*. Bent area 248*b* is provided on bridge 248*e*. The width of hook 248*d* is narrower than primary slits 243*a* and 243*b*. Bridge 248*e* and leg 48*f* are narrower than groove 246 which connects primary slits 243*a* and 243*b*. Bent area 248*b* corresponds to specified area 247*c* of slide block 247. Secondary engagement members 249 and 250 have convex areas 249*a* and 250*a* respectively on one ends of L-shaped plate springs. The other ends are fastened to corners 251 and 252 of slide block 247.

Figure 18:
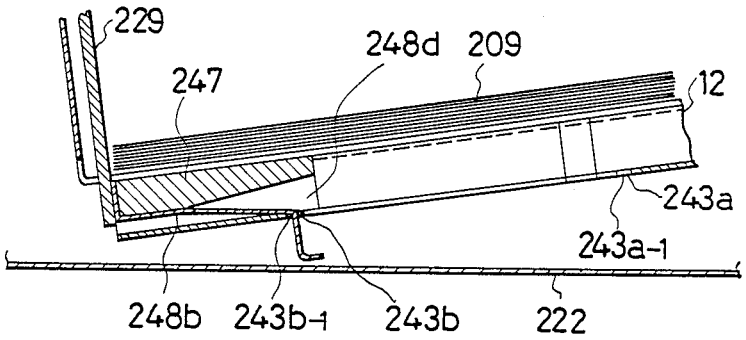
FIG. 18 is a cross section view on line M–N of FIG. 16 during media set.
Figure 19:
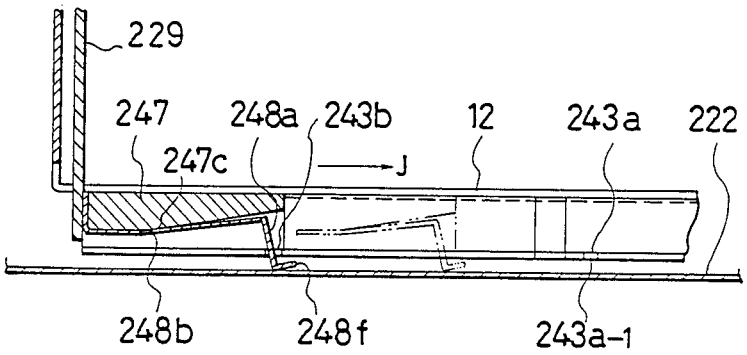
FIG. 19 is a cross section view on line M–N of FIG. 16 media reset.
Figure 20A:
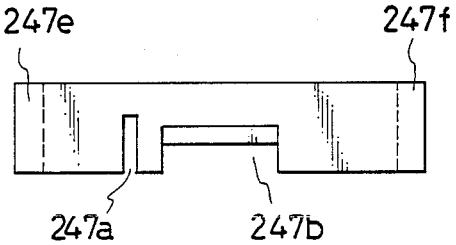
FIG. 20A is a front view of the slide block.
Figure 20B:
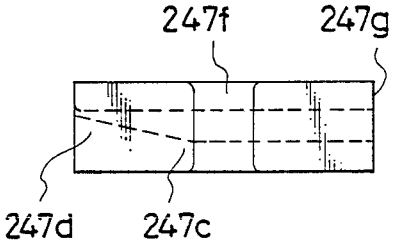
FIG. 20B is a side view of FIG. 20A.

FIG. 18 and FIG. 19 will next be added to explain the operation. FIG. 18 is an M–N cross section view of FIG. 16 during media set. FIG. 19 is an M–N cross section view of FIG. 16 during media reset.

Media 209 in FIG. 18 is loaded on media load plate 17 and is in the set state. In this state hook 248*d* of primary engagement member 248 is engaged with straight area 243*b*-1 of primary slit 243*b* on guide bracket 241. When loading media 209*a*, a lever not shown is rotated in the direction shown by arrow E in FIG. 2 and in FIG. 3A, causing shaft 30 to rotate in the same direction and media load plate 17 to be rotated by reset arm 34 in the direction of arrow F with rotational fulcrum 18 as center and lowered. When media load plate 17 is lowered, leg 248*f* of primary engagement member 248 strikes cassette frame 222, as shown in FIG. 19. When media load plate 17 is further lowered, specified area 247*c* of slide block 247 pushes on bent area 248*b* of primary engagement member 248, causing bent area 248*b* to curve to the opposite side after bridge 248*c* has bent the specified amount. This results in the disengagement of primary slit 243*b* of guide bracket 241 and hook 248*d* of primary engagement member 248. Where they were disengaged shaft 30 is set by a means not shown in the drawings, making it possible to pull paper cassette 12 out of device main body 11 in the direction of arrow A in FIG. 4 together with a lever not shown. When guide plate 229 is pushed in the direction of arrow J as shown in FIG. 16 after paper cassette 12 has been pulled out, slide block 247 moves along guide rail 242 of guide bracket 241 as shown by the phantom lines in FIG. 19 and secondary slits 244*a* and 244*b* of slide bracket 241 engage with secondary engagement members 249 and 250 of slide bracket 247. Slide block 247 is stopped in this position and because, in this position, primary engagement member 248 is directly below primary slit 243*a* which corresponds to media 209 which is being loaded, when media 209 is loaded onto media load plate 17 and paper cassette 204 is pushed in the direction of arrow A′ as shown in FIG. 4 and said unshown lever is rotated in the direction of arrow E′, shaft 30 and reset arm 31 are released and media load plate 17 is pushed up by coil springs 33*a* and 33*b*. When media load plate 17 is pushed up, bent area 248*b* of engagement member 248 returns to its normal state, hook 248*d* engages with the straight section of primary slit 243*a*, slide block 247 is unable to move in the direction shown by arrow B′ in FIG. 2 and guide plate 229 is placed in a specified position. Therefore, the front edge of media 209*a* is placed in a specific position with regards to main body 11.

Figure 21:
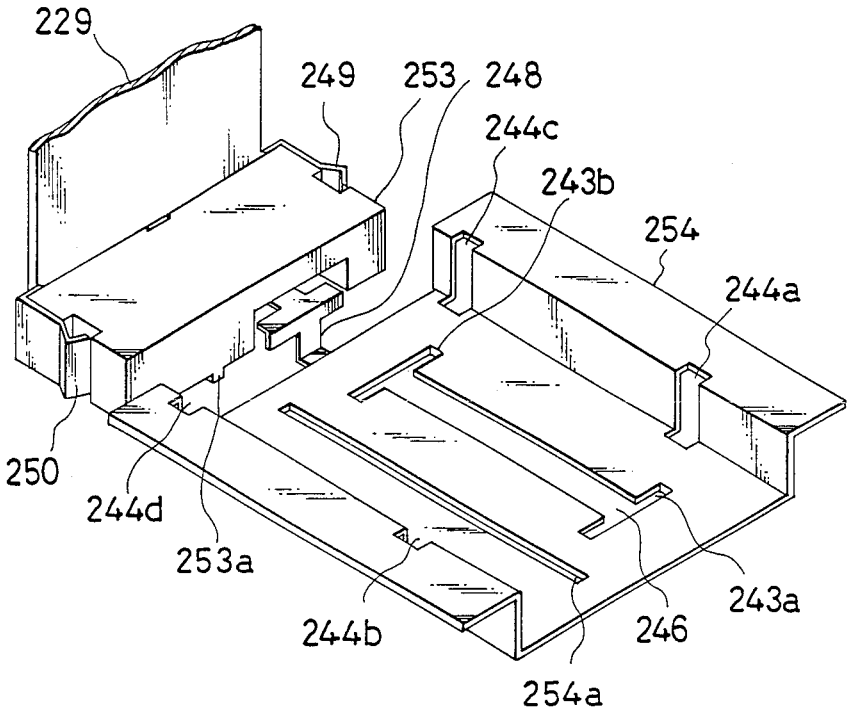
FIG. 21 is an external perspective view of a media back edge guide assembly for an automatic paper feed device according to another embodiment.

FIG. 21 is an external perspective view of a media back edge guide assembly for an automatic paper feed device according to a further embodiment. The fixed members and the movable members have been separated for ease of viewing. The points of difference from the abovedescribed embodiment of FIG. 16 through FIG. 20 are that guide 253*a* is provided on the slide face of slide block 253, and that guide bracket 254*a* is provided on the slide face of guide bracket 254.

The operation of the this embodiment is the same as that of the embodiment of FIG. 16 through FIG. 20.

In the embodiment of FIG. 21, machine finishing is used rather than pressing for cutting and turning, giving it outstanding precision and sufficiently wide primary slits.

Figure 22:
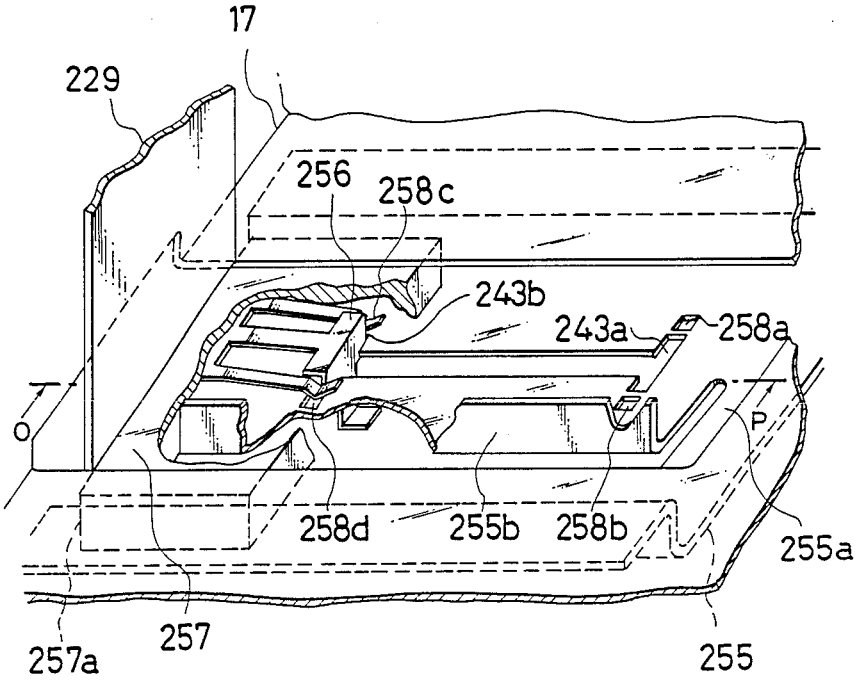
FIG. 22 is an external perspective view of a media back edge guide assembly for an automatic paper feed device according to a further embodiment.
Figure 23:
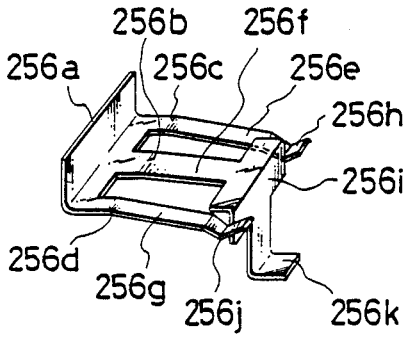
FIG. 23 is an external perspective view of the engagement member.
Figure 24:
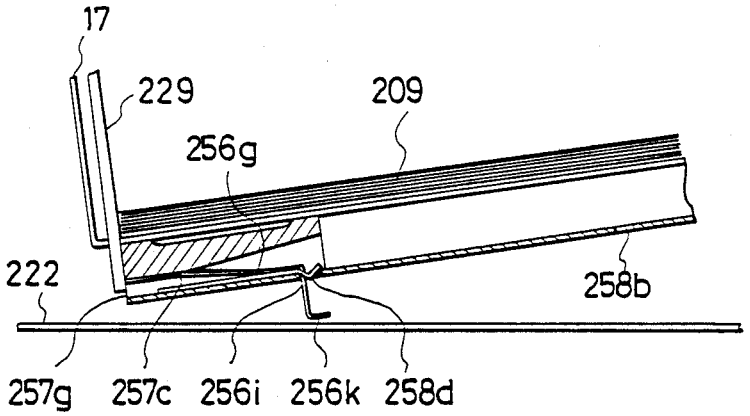
FIG. 24 is a cross section view on line O–P of FIG. 22 during media set.
Figure 25:
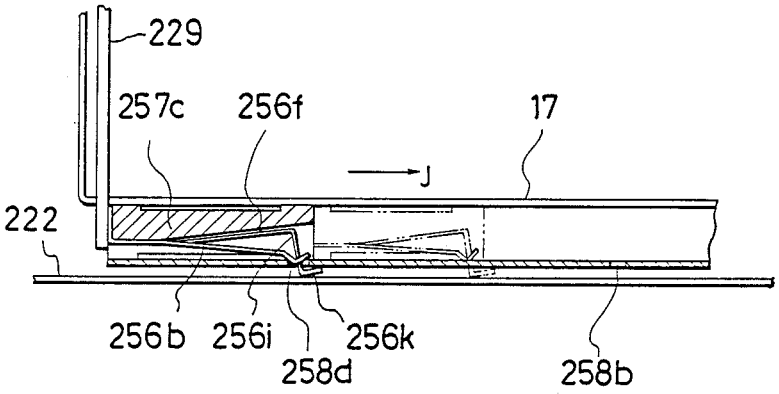
FIG. 25 is a cross section view on line O–P of FIG. 22 during media reset.
Figure 26A:
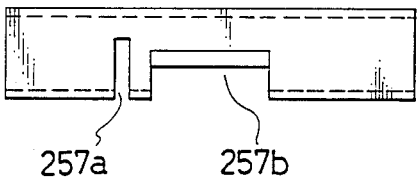
FIG. 26A is a front view of the slide block.
Figure 26B:
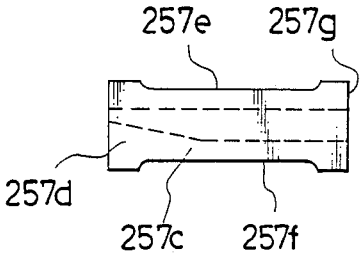
FIG. 26B is a side view of FIG. 26A.

A further embodiment of the invention will be described with reference to FIG. 22 through FIG. 26B. This embodiment is similar to the embodiment of FIG. 16 through FIG. 20. The points of difference from the embodiment of FIG. 16 through FIG. 20 are that the secondary slits are provided on the slide face of the guide bracket, and that the primary engagement member and the secondary engagement member have been integrated into a single engagement member. It is also possible for the primary slits and the secondary slits to be integrated into one continuous slit. FIG. 22 is an external perspective view of media back edge guide assembly for an automatic paper feed device according to this embodiment. FIG. 23 is an external perspective view of the engagement member. FIG. 24 is a cross section view on line O—P of FIG. 22 during media set. FIG. 25 is a cross section view on line O—P of FIG. 12 during media reset. FIG. 26A is a front view of the slide block. FIG. 26B is a side view of FIG. 26A. In FIG. 22, secondary slits 258*a* and 258*b*, which correspond to primary slit 243*a*, are provided on slide face 255*a* of guide bracket 255, as are secondary slits 258*c* and 258*d*, which correspond to primary slit 243*b*. As shown in FIG. 26A and FIG. 26B, on slide block 257 are provided: guide groove 257*a*, which engages with guide rail 255*b* of guide bracket 255; groove 257*b*, to which is attached engagement member 256; and grooves 257*e* and 257*f*, which are for decreasing the friction between slide face 255*a* of guide bracket 255 and the back face of media load plate 17. Groove 257*b* becomes slant face 257*d* from specified area 257*c*.

Engagement member 256 is, as shown in FIG. 23, substantially E-shaped. Fastening section 256*a* of engagement member 256 is held between side face 257*g* of slide block 257 and guide plate 229, and is fastened together with guide plate 229 to slide block 257 by a screw not shown, as in FIG. 22. Center arm 256*f* of engagement member 256 corresponds to engagement member 248 of the first embodiment and on it are provided bent area 256*b*, hook 256*i* and leg 256*k*. On the two arms, 256*e* and 256*g*, which surround center arm 256*f* are provided bent areas 256*c* and 56*d* respectively, and on their tips are provided protrusions 256*h* and 256*j* respectively.

The operation will be explained next. When media load plate 17 is lowered as in the previously-described embodiments, leg 256*k* of engagement member 256 strikes cassette frame 222, as shown in FIG. 25. When media load plate 17 is further lowered, specified area 257*c* of slide block 257 pushes bent area 256*b* of central arm 256*f*, causing bent area 256*b* of central arm 256*f* to bend to the opposite side. This results in the disengagement of primary slit 243*b* of guide bracket 255 and hook 256*i* of engagement member 256. When they are disengaged, paper cassette 12 is pulled out of body 11 as in the previously-described embodiment and media 209 is loaded onto media load plate 17. When guide plate 229 is pushed in the direction of arrow J as shown in FIG. 25, protrusions 256*h* and 256*j* of arms 256*e* and 256*g* of engagement member 256 come out of secondary slits 258*c* and 258*d* respectively. Slide block 257 then moves along guide rail 255*b* of guide bracket 255 as shown by the phantom lines and secondary slits 258*a* and 258*b* engage with protrusions 256*h* and 256*j*. Central arm 256*f* of engagement member 256 is also directly under primary slit 243*a* in this position. Subsequent operation is the same as for the embodiment of FIG. 16 through FIG. 20.

The above embodiment has the advantages of there being one engagement member, and the primary slits and secondary slits being on the same face, making it easy to process.

Figure 27:
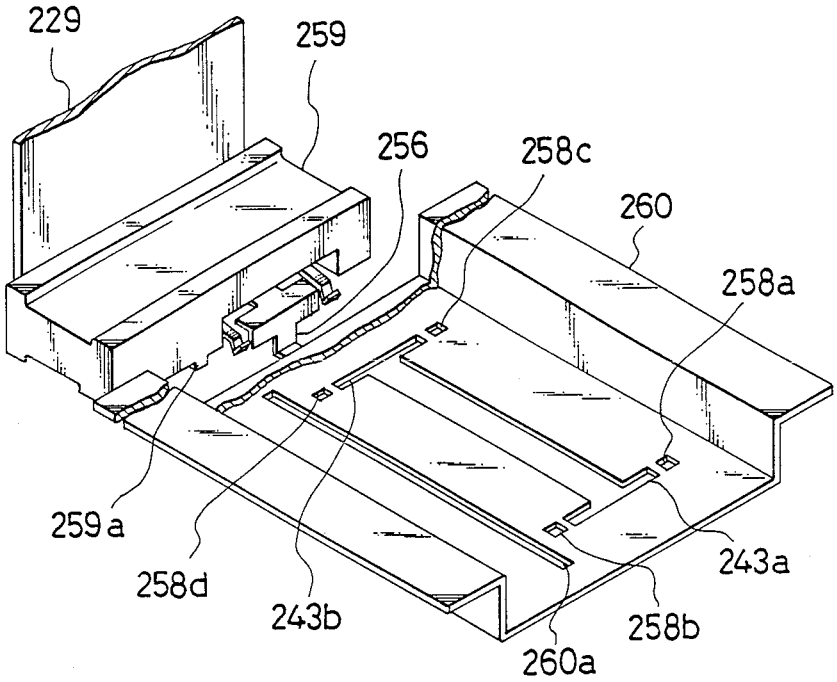
FIG. 27 is an external perspective view of a media back edge guide assembly for an automatic paper feed device according to a further embodiment.

FIG. 27 is an external perspective drawing of a media back edge guide assembly for an automatic paper feed device according to a further embodiment. The fixed members and the movable members have been separated for ease of viewing. The points of difference between this embodiment and the third embodiment are that guide 259*a* is provided on the slide face of slide block 259, and guide groove 260*a* is provided on the slide face of guide bracket 260.

The operation of this embodiment is the same as that of the embodiment of FIG. 22 through FIG. 28.

In the above embodiment machine finishing is used rather than pressing for cutting and turning, giving it superier precision and making it possible to bring the slits to the center of the slide face.

Figure 28:
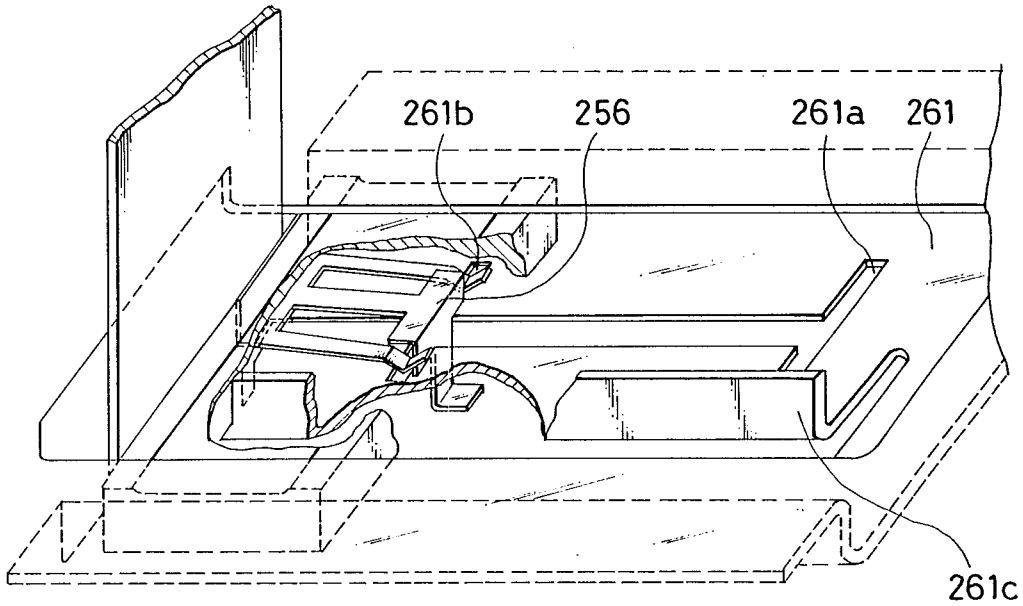
FIG. 28 is an external perspective view of a media back edge guide assembly for an automatic paper feed device according to a further embodiment.

FIG. 28 is an external perspective drawing of a media back edge guide assembly for an automatic paper feed device according to a further embodiment. The point of difference between this embodiment and the embodiment of FIG. 22 through FIG. 26 is that the primary slits and secondary slits provided on the slide face of the guide bracket have been made into a single unit. In FIG. 28, slits 261*a* and 261*b* are wider than engagement member 256 and are provided on the slide face of guide bracket 261 in positions corresponding to the sizes of the media.

The operation of the above embodiment is the same as that of the embodiment of FIG. 22 through FIG. 26.

In the above embodiment the engagement member and the engagement section are of the same type and therefore easy to process.

Figure 29:
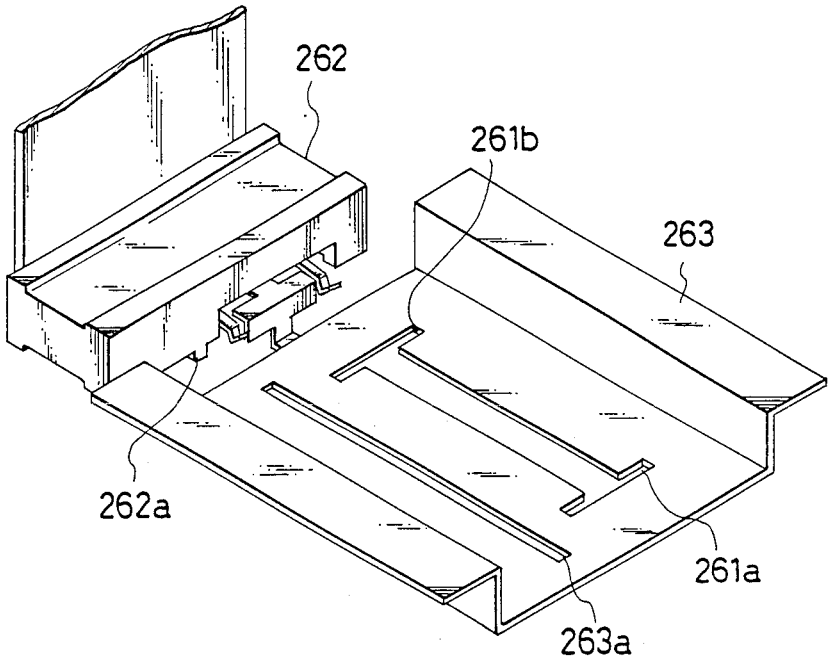
FIG. 29 is an external perspective view of a media back face guide assembly for an automatic paper feed device according to a further embodiment.

FIG. 29 is an external perspective drawing of media back edge guide assembly for an automatic paper feed device according to the sixth embodiment. The fixed section and the movable section have been separated for easy of viewing. The points of difference between this embodiment and the fifth embodiment are that guide 262*a* is provided on the slide face of slide block 262, and that guide groove 263*a* is provided on the slide face of guide bracket 263.

The operation of the above embodiment is the same as that of the embodiment of FIG. 28.

In the above embodiment machine finishing is used rather than pressing for cutting and turning, giving it superier guide precision and allowing the slits to be brought to the center of the slide face.

In this embodiment a secondary engagement section, a secondary engagement member, a guide rail and a guide groove have been added, but it is possible to do without them.

Figure 30:
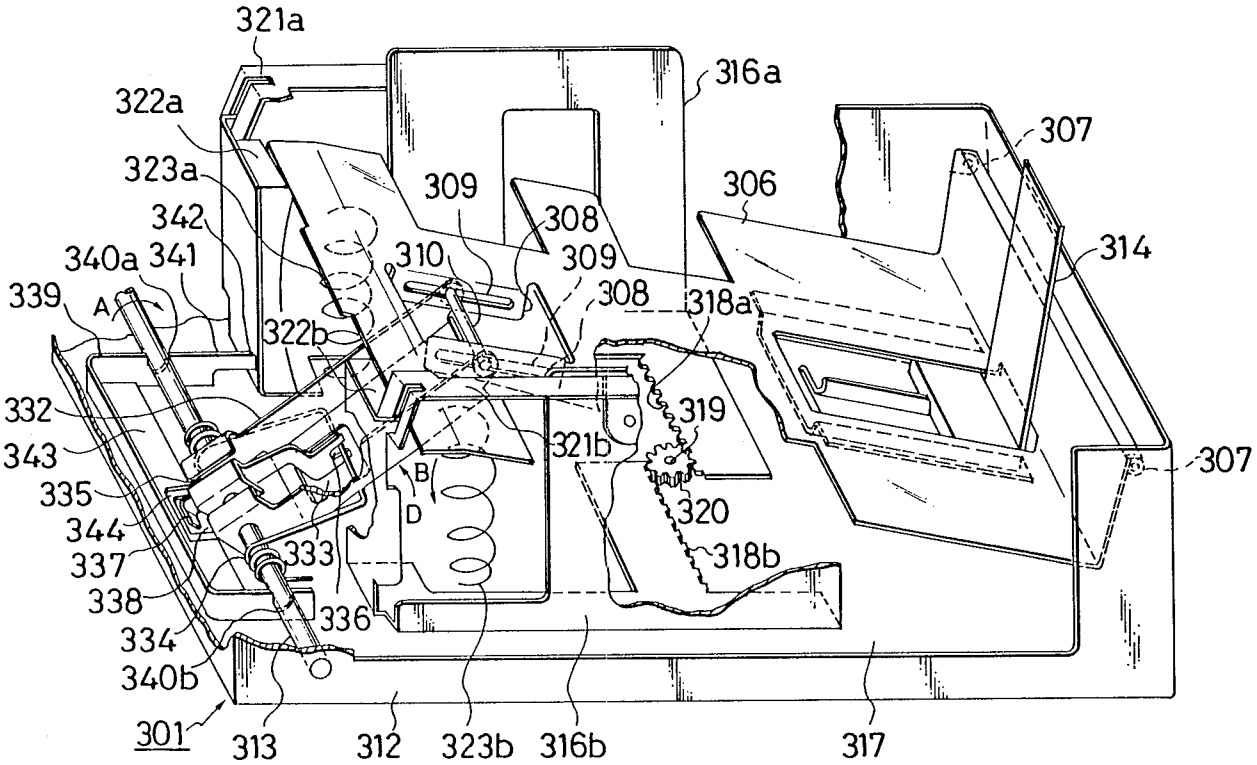
FIG. 30 is a cut-away perspective view showing another embodiment of paper cassette according to this invention.
Figure 31:
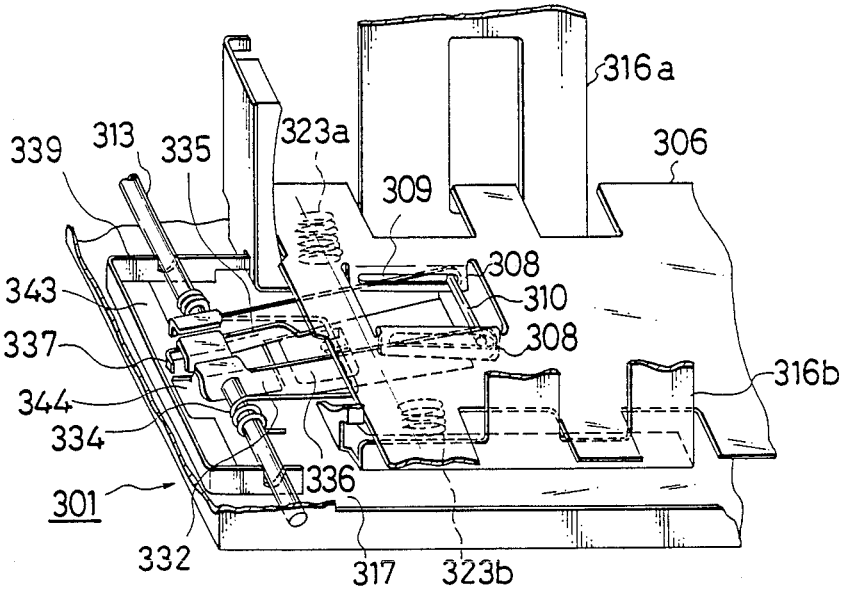
FIG. 31 is a cut-away perspective view showing the lowered state of the media load plate.

A further embodiment of this invention will be explained referring to FIG. 30 through FIG. 32. FIG. 30 is a cut-away perspective drawing of a paper cassette according to this embodiment. FIG. 31 is a front view showing the state of a paper cassette according to this embodiment when it is installed in a paper feed device.

The structure will be explained first.

Paper cassette 301 is attached so that L-shaped media load plate 306 is able to rotate with fulcrum 307 as center. A pair of flanges 308 are formed in the front bottom of media load plate 306. On flanges 308 are oval hole 309. Shaft 310 is inserted into oval holes 309 so that it is able to slide. Both ends of shaft 310 are attached to reset arm 332. Thus reset arm 332 is attached through shaft 310 to the front bottom of media load plate 306. Media back edge guide plate 314 is also attached to the back of media load plate 306. Media back edge guide plate 314 positions the media loaded on media load plate 306 in the feed direction. In order to respond to the size of the media, media back edge guide plate 314 is able to move along guide rail 315, which is formed in the feed direction.

Side plates 316*a* and 316*b*, which position the media in the width direction, are mounted on each side of media load plate 306. Racks 318*a* and 318*b* are formed on side plates 316*a* and 316*b* along the bottom plate of frame 312. Racks 318*a* and 318*b* mate with pinion 320 which rotates on post 319 attached to bottom plate 317. Separation claws 321*a* and 321*b* are also attached to side plates 316*a* and 316*b*. Guide blocks 322*a* and 322*b* are formed in the front areas of the side plates 316*a* and 316*b*.

A pair of coil springs 323*a* and 323*b* are mounted in the front bottom area of media load plate 306 in the space between it and bottom plate 317. The force with which said coil springs 323*a* and 323*b* push up media load plate 306 is set to a pressure appropriate for pushing smaller media against hopping roller, not shown, when they are stored on media load plate 306.

Reset arm 332 is attached at two points to shaft 313 jounalled by frame 312 of cassette 301. Reset arm 332 is provided with an opening 333. Attached to shaft 313 on both sides of reset arm 332 is torsion spring 334, which is the auxiliary resilient member. The torsion spring 334 is bent around the back of reset arm 332 and constantly energizes reset arm 332 upwards.

Furthermore, sub-arm 335 is attached to shaft 313 in between the attachment points of reset arm 332. A U-shaped cutout 336 is formed on one end of sub-arm 335.

This cutout holds torsion spring 334 in the bottom of opening 333. L-shaped protrusion 337 is formed on the other end of sub-arm 335. Clearance opening 338 is formed in the position on bottom plate 317 where the protrusion 337 moves to when sub-arm 335 rotates in the direction shown by arrow D in FIG. 30. This makes it possible for sub-arm 335 to rotate further.

Bracket 339 is provided on the bottom of the shaft 313. Shaft 313 is installed between U-shaped holes 340*a* and 340*b* of bracket 339. The tip of arm section 341 of bracket 339 goes into hole 342 provided on side plate 316*a*. Therefore, when side plate 316*a* moves according to the size of the media, it is accompanied by bracket 339 which thereby moves parallel to shaft 313. Plate 343 is also provided on bracket 339. Opening 344 is provided on plate 343 in a position which overlaps the position of clearance hole 338 on bottom plate 317 when bracket 339 is moved to store a wide media.

The operation of the embodiment will be explained next.

Explanation of the storage of a large or wide media in the paper cassette will first be made. Until paper cassette 301 is pulled out of device 11, media load plate 306 is in a lowered state and is held in this state by a locking means not shown in the drawings. Media back edge guide plate 314 is then moved along guide rail 315 so that it fits the size (length) of the media. Side plates 316*a* and 316*b* are also moved to fit the size (width) of the media. When side plate 316*a* is moved to fit the size of the media, side plate 316*b* is moved by pinion 320 the same distance in the opposite direction. Also the movement of side plate 316*a* causes a parallel movement in bracket 339 and shaft 313. At this time opening 344 on bracket 339 moves to a position which overlaps clearance hole 338 of bottom plate 306.

A wide media is now set and paper cassette 301 is returned to device 11. Next, the unshown locking means described above is released. This causes media load plate 306 to be rotated and raised by a pair of coil springs 323*a* and 323*b*. The direction of rotation is opposite to that shown by arrow B and fulcrum 307 is the center. This pushes the top of the media against the hopping roller. Reset arm 332 also rotates in the direction shown by arrow D to accompany this movement with shaft 313 as center. Opening 344 of bracket 339 and clearance hole 338 of bottom plate 317 are positioned in the rotation range of protrusion 337 at this time, making even more rotation possible. Therefore, torsion spring 334, which is inside groove 336 of sub-lever 335, rotates with shaft 313 as center so that it follows the rotation of reset arm 332. The top of the media is pushed against hopping roller, and though the rotation of reset arm 332 is stopped, torsion spring 334 pushes farther up from the back of reset arm 332. This upward pushing force becomes a force pushing up media load plate 306.

Therefore the pressure which pushes the top of a large media stored on media load plate 306 against the hopping roller is the combined upward pushing force of coil spring pair 323*a* and 323*b*, and torsion spring 334. Hopping roller is then rotated so that paper feed is performed with the appropriate pressure.

Explanation of the operation when a small or narrow media is stored will be made next referring to FIG. 31 and FIG. 32. FIG. 31 is a cut-away perspective view showing the lowered state of the media load plate 306. FIG. 32 is a cut-away perspective view showing the raised state of the media load plate 306. The operations up to the point where media load plate 306 is lowered and side plates 316*a* and 316*b* and media back edge guide plate 314 are moved to fit the size of the media are the same as those described above and will therefore be omitted.

Bracket 339 moves parallel to shaft 313 to accompany the movement of side plate 316*a*. Because protrusion 337 of sub-arm 335 is separated from plate 343 of bracket 339 at this time, bracket 339 is able to move smoothly. As shown in FIG. 31, bracket 339 moves until plate 343 is in a position over clearance hole 338 of bottom plate 317. A smaller media is then stored on media load plate 306.

Figure 32:
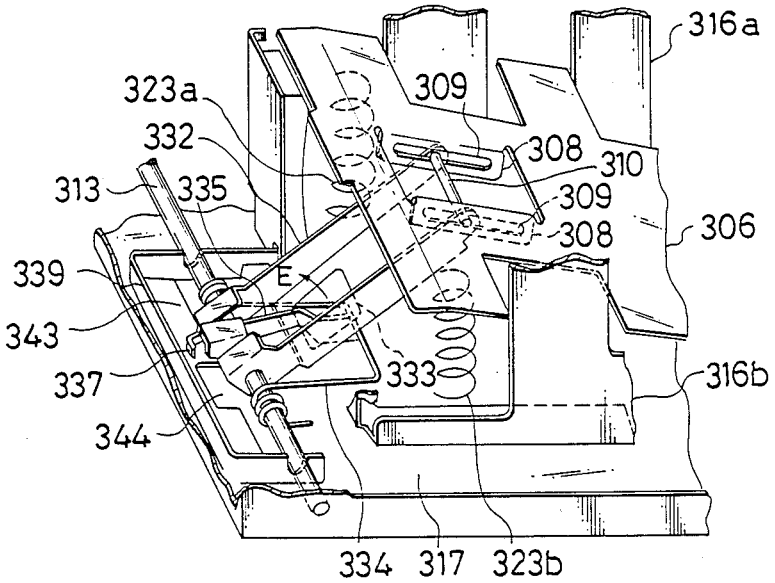
FIG. 32 is a cut-away view showing the raised state of the media load plate.

The unshown locking means is then released and, as shown in FIG. 32, this causes media load plate 306 to be pushed up by coil spring pair 323*a* and 323*b*. Accompanying this, reset arm 332 is pulled up by media load plate 306, rotating upwards with shaft 313 as center. Torsion spring 334 and sub-arm 335 attempt to rotate with shaft 313 as center in the direction shown by arrow E in FIG. 32, but are prevented from doing so because protrusion 337 of sub-lever 335 strikes plate 343 of bracket 339. Therefore, as shown in FIG. 32, reset arm 332 and torsion spring 334 are isolated. This means that the force pushing up media load plate 306 is only the upward pushing force of coil spring pair 323*a* and 323*b*. Because the upward pushing force of coil spring pair 323*a* and 323*b* is set so as to be appropriate for smaller media, the pressure pushing the top of the media against the hopping roller is a pressure appropriate for the feeding of smaller media. The paper feed operation is the same as for the feeding of larger media.

In this embodiment, a torsion spring was used as the auxiliary resilient member energizing the reset arm. It is, of course, possible to use something other than this, a plate spring, for example.

Figure 33:
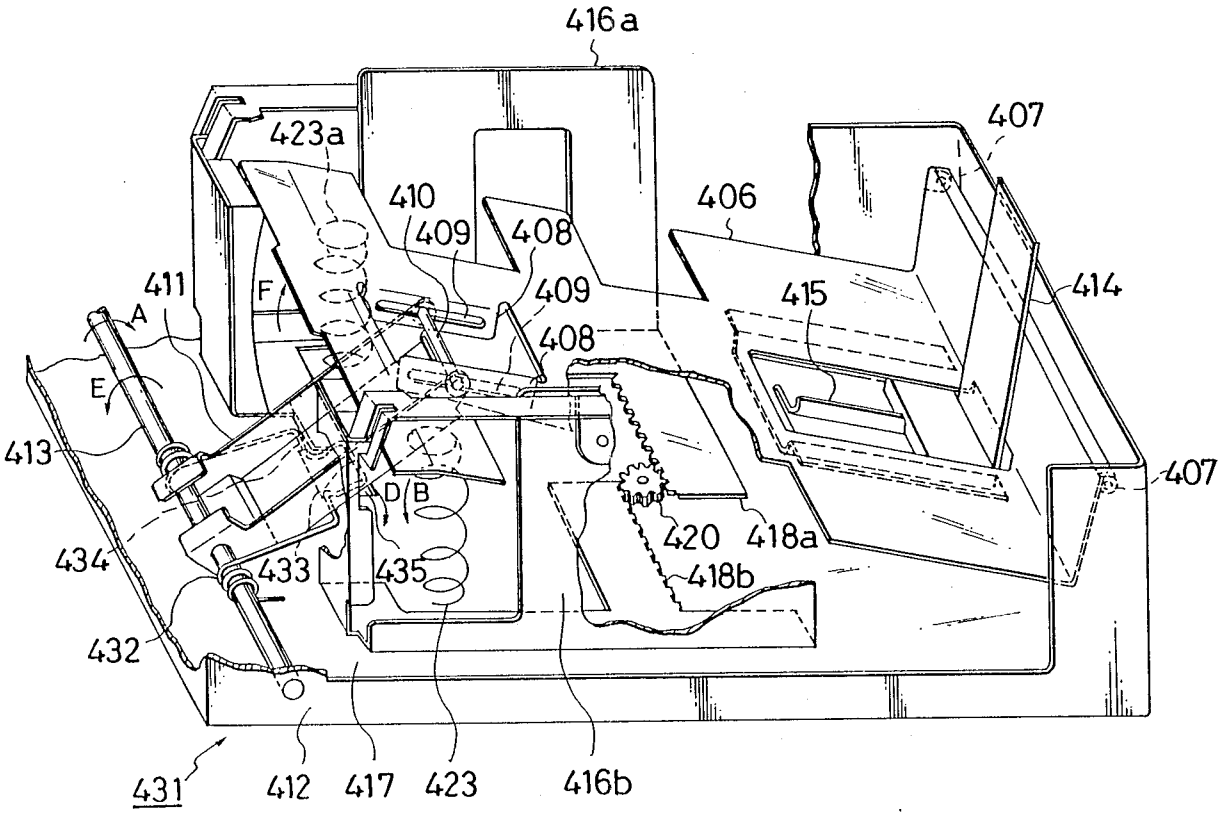
FIG. 33 is a cut-away perspective view showing another embodiment of this invention.
Figure 34:
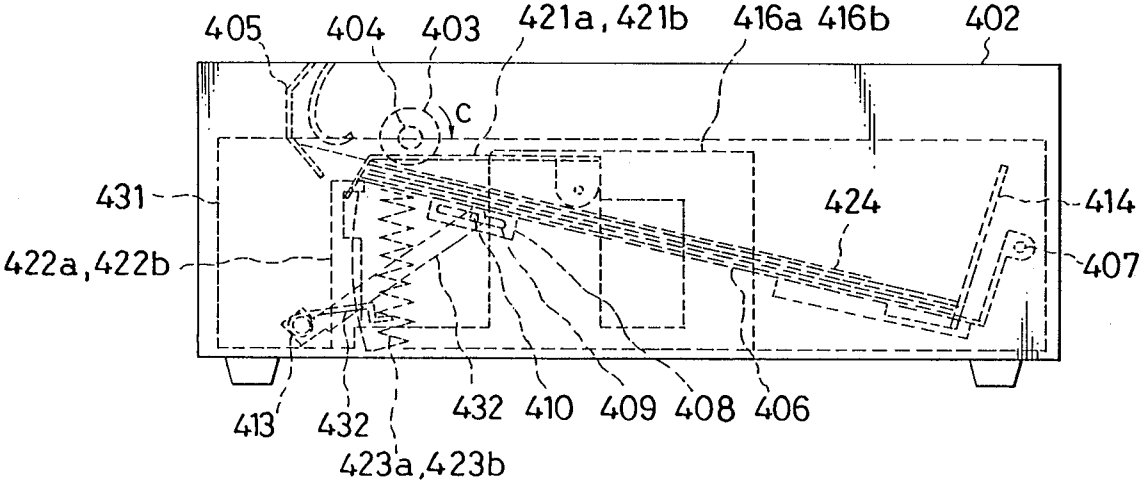
FIG. 34 is a front view showing the state of paper cassette according to the embodiment of FIG. 34 when it is installed in a paper feed device.

Another embodiment of this invention will be explained referring to FIG. 33 through FIG. 37. FIG. 33 is a cut-away perspective drawing of a paper cassette according to this embodiment. FIG. 34 is a front view showing the state of this embodiment of a paper cassette when it is installed in a paper feed device.

This embodiment is similar to the embodiment of FIG. 30 through FIG. 32. The points of difference are as follows: Tip 433 of torsion spring 432 is bent downwards in an L shape around the back of reset arm 411 and constantly energizes reset arm 411 upwards. Convex member 434 is formed integrally in side plate 416*a* facing bottom plate 417. Opening 435 is provided in the front part of bottom plate 417.

Sub-arm 315 and clearance opening 338 of the embodiment of FIG. 30 through FIG. 32 are omitted.

The operation of the embodiment will be explained next.

In order to store media 424 in paper cassette 431, shaft 413 is first rotated in the direction shown by arrow A by a lever not shown in the drawings. This causes reset arm 411 to rotate in the direction shown by arrow D with shaft 413 as its center. Media load plate 406 then rotates in the direction shown by arrow B with fulcrum 407 as its center and is lowered. The rotation of reset arm 411 causes torsion spring 432 to rotate in the same direction. When reset arm 411 has rotated to a specified position it is held in that state by a holding means not shown in the drawings. At this time tip 433 of torsion spring 432 enters opening 435 provided on bottom plate 417. Torsion spring 432 is located below bottom plate 417. Cassette 431 is pulled out from the device in this state.

Explanation of the storage of a large or wide media in the cassette will be made first. Media back edge guide plate 414 is moved along guide rail 415 to the length of the media. Side plate 416*a* is also moved to fit the length of the media in the width direction. When side plate 416*a* is moved to fit the size of the media, side plate 416*b* is moved by pinion 420 the same distance in the opposite direction.

A large media is now set and paper cassette 431 is pushed back into device 11. Next, shaft 413 is rotated in the direction shown by arrow E in FIG. 33 by a lever not shown in the drawing, and reset arm 411 is released. This causes media load plate 406 to be rotated and raised by a pair of coil springs 423*a* and 423*b*. The direction of rotation is shown by arrow F and fulcrum 407 is the center. This pushes the top of the media against hopping roller 403. Reset arm 411 also rotates with shaft 413 as center, being pulled up by media load plate 406. At this time torsion spring 432 rotates with shaft 413 as its center following the rotation of reset arm 411. The top of the media is pushed against a hopping roller 403 and though the rotation of reset arm 411 is stopped, torsion spring 432 pushes farther up from the back of reset arm 411. This upward pushing force becomes a force pushing up media load plate 406.

Therefore the pressure which pushes the top of a large media stored on media load plate 406 against hopping roller 403 is the combined upward pushing force of coil spring pair 423*a* and 423*b*, and torsion spring 432. Hopping roller 403 is then rotated in the direction shown by arrow C in FIG. 34, the media is separated into sheets by separation claws 421*a* and 421*b*, and paper feed is thus accomplished.

Figure 35:
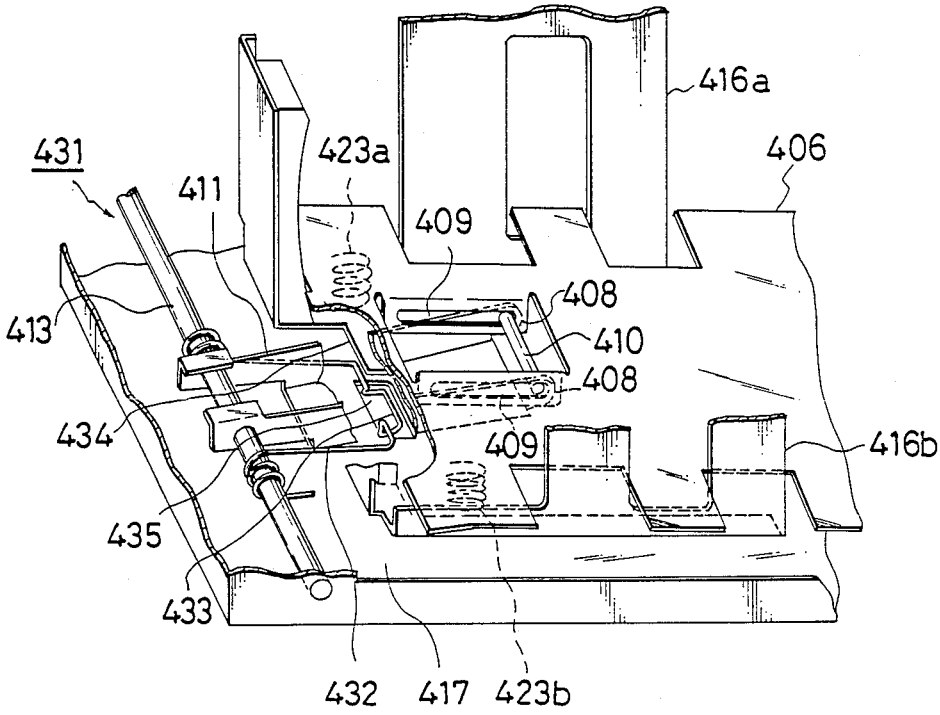
FIG. 35 is a cut-away perspective view showing the state of the media load plate lowered in the embodiment of FIG. 34.
Figure 36:
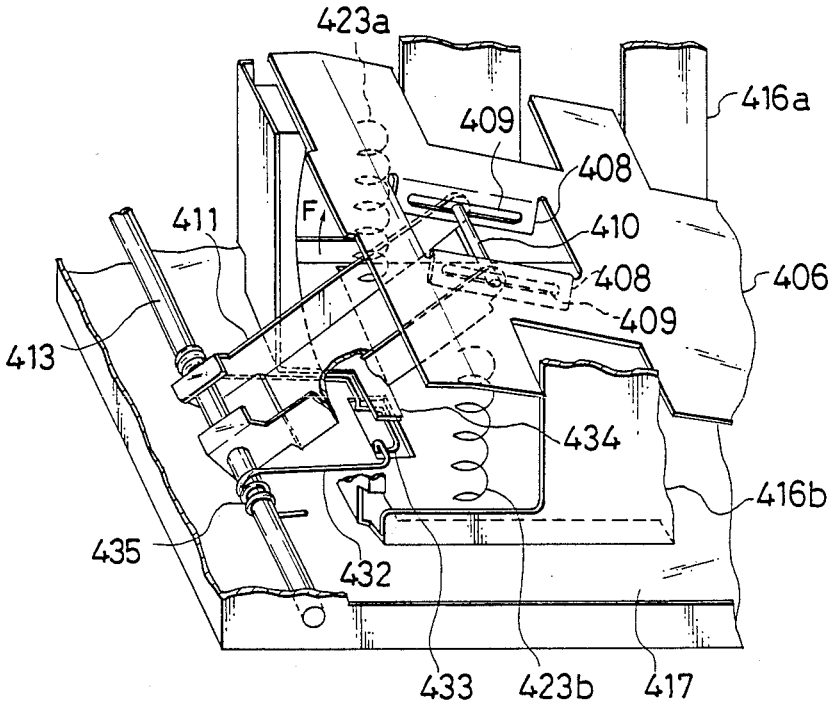
FIG. 36 is a cut-away view showing the state of the media load plate raised in the embodiment of FIG. 34.

Explanation of the operation when a small media is stored will be made next referring to FIG. 35 and FIG. 36. FIG. 35 is a cut-away perspective drawing showing the state in which the media load plate is lowered. FIG. 36 is a cut-away perspective drawing showing the state in which the media load plate is raised.

As described above, media load plate 406 of paper cassette 431, which has been pulled out of paper feed device 11 in order to set the media, is lowered as shown in FIG. 35, and tip 433 of torsion spring 432 is in opening 435. Media back edge guide plate 414 and side plates 416*a* and 416*b* are moved respectively to the length in the direction of paper feed and the width of the media. The movement of side plate 416*a* causes convex member 434 to move to a position above opening 435 of bottom plate 417. A small media is then loaded on media load plate 406 and set, and cassette 431 is returned to device 402.

Next, shaft 413 is rotated in the direction shown by arrow E in FIG. 33 by a lever not shown in the drawings, and reset arm 411 is released. This causes media load plate 406 to be rotated and raised by a pair of coil springs 423*a* and 423*b*. The direction of rotation is shown by arrow F in FIG. 36 and fulcrum 407 is the center. This pushes the top of the media against hopping roller 403. Reset arm 411 also rotates upwards with shaft 413 as center, being pulled up by media load plate 406. At this time torsion spring 432 also rotates following the rotation of reset arm 411. However tip 433 strikes the convex member 434 and torsion spring 432 is prevented from rotating. Therefore, as shown in FIG. 36, reset arm 411 and torsion spring 432 separate. This means that the force pushing up media load plate 406 is only the upward pushing force of coil springs 423*a* and 423*b*. Because the upward pushing force of coil spring pair 423*a* and 423*b* is set so as to be appropriate for smaller media, the pressure pushing the top of the media against hopping roller 403 is a pressure appropriate for the feeding of smaller media. The hopping roller 403 is rotated, and the media is separated into sheets by separation claws 421*a* and 421*b*. The paper feed is thereby performed.

Figure 37:
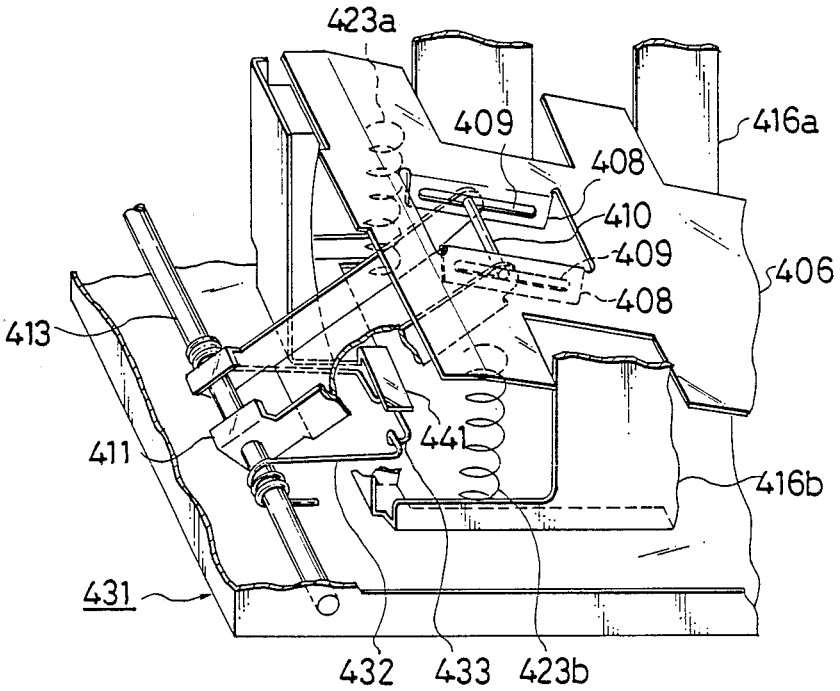
FIG. 37 is a cut-away perspective view of a further embodiment of this invention.

A further embodiment of this invention will be explained referring to FIG. 37.

In this embodiment, as in the embodiment of FIG. 33 through FIG. 36, the torsion spring 432 has a tip 433 which is bent downwards in an L shape, and torsion spring 432 is attached to shaft 413. In place of convex member 434 of the embodiment of FIG. 34 through FIG. 37, convex member 441, bent upwards in an L shape, has been formed integrally with side plate 416*a*.

When a large media is stored on it, convex member 441 is separated from tip 433 of torsion spring 432 by the movement of side plate 416*a*. This causes torsion spring 432 to be able to rotate freely. When a small media is stored on it, convex member 441 moves so that it covers the top of tip 433 of torsion spring 432, preventing torsion spring 432 from rotating. Therefore the same effects are obtainable as from the embodiment of FIG. 33 through FIG. 36. Furthermore, because there is no need to provide an opening on the bottom plate of the cassette in the above embodiment, it has the effect of simplifying the structure.

As explained in detail above, when loading and storing wide media and narrow media on a media load plate, the above-described embodiments make it possible to obtain a large upward pushing force for wider media as well as an appropriate force for narrower media. Therefore, the pressure with which the top of the media is pushed against the hopping roller will be a pressure appropriate to the size of the media. This will eliminate double feeding and feeding misses generated during feeding due to the differences in media size. Thus a paper cassette which is able to perform feeding in a stable manner may be provided with a simple parts structure and at an inexpensive cost.

What is claimed is:

1. A paper cassette which stores media on a media load plate, said media load plate being journalled at one end so that it is able to rotate and being raised and lowered by moving the other end, and which performs paper feed by pushing up said other end of the media load plate with a spring thereby pressing the top of the media against a hopping roller, wherein said media load plate has an opening toward said one end, said paper cassette comprising:

a guide bracket attached to said media load plate so that it covers the opening from the lower side of said media load plate, said guide bracket possessing multiple first stopping means in positions corresponding to the lengths in the media delivery direction of the multiple types of media, and a media back edge guide assembly which is able to move in the delivery direction of the media, which possesses a second stopping means which engages with one of said first stopping means, and which is positioned according to the sizes of a number of types of media, said media back edge guide assembly comprising a slide block and a guide plate said slide block being provided between the media load plate and said guide bracket.

2. A paper cassette as set forth in the claim 1, in which said first stopping means are constructed by forming a number of slits in specified positions on said guide bracket, and in which said second stopping means is constructed of a convex section of a resilient member attached to said media back edge guide assembly.

3. A paper cassette as set forth in claim 1, in which said first stopping means are constructed by forming a number of concave areas in specified positions on said guide bracket, and in which said second stopping means is provided on said media back edge guide assembly and constructed of a protruding member biased in a direction perpendicular to the delivery direction.

4. A paper cassette as set forth in claim 1, in which said first stopping means are provided in specified positions on said guide bracket and constructed of a number of protruding members biased in a direction perpendicular to the delivery direction, and in which said second stopping means is constructed by forming a concave area on said media back edge guide assembly.

5. A paper cassette as set forth in claim 1, in which said stopping means are constructed by forming a number of rectangular holes at specified positions on said guide bracket, and in which said second stopping means is formed of a plate provided on said media back edge guide assembly so that it is able to move in a direction perpendicular to the delivery direction.

6. A paper cassette as set forth in claim 1, wherein said media back edge guide assembly further comprises:

a plate spring having a convex portion which forms said second stopping means, and said first stopping means of said bracket comprising slits provided at positions corresponding to the sizes of the media, wherein the slits of the plate spring are engageable with each other to lock the slide block to the media load plate.

7. A paper cassette for an automatic paper feed device in which a medium is loaded and stored on a media load plate and pressed by it onto a delivery roller and which positions the front edge of the medium in regards to the direction of media delivery at a fixed position in relation to a main body, comprising a media back edge guide assembly comprised of:

a movable member on which is installed a guide plate which positions the back edge of the medium and an engagement member which abuts said guide plate in the media delivery direction, and a fixed member on which are provided engagement sections which engage with the engagement member at positions which correspond to the lengths of the medium in the direction of media delivery and a groove which connects the engagement sections, said media back edge guide assembly being provided on the media load plate, said movable member being able to slide back and forth in the direction of the media delivery in regards to the fixed side member, said engagement section being in the form of a slit provided on the sliding face perpendicular to the media delivery direction, and the engagement member being substantially L-shaped having a substantially right-angle area and possesses a mounting section at one end, a wide section in the substantially right-angle area and a bending section between the mounting section and the wide section, the mounting section being fixed to the sliding face of the movable member, the other end jutting out from the fixed member through the slit toward the main body, the slit being engaged with the wide section so that when the media load plate is lowered, the slit and the wide section become disengaged and the movable member is able to slide on the fixed member, and when the media load plate is raised, the slit and wide section engage, and the movable member being provided with a plate spring fixed to the fixed member.

8. An automatic paper feed device which stores multiple types of different sized media in a single paper cassette having a bottom plate and performs paper-feeding comprising:

a media load plate on which is loaded said multiple types of different sized media, said media load plate being fixed to the paper cassette in such a way that its entirety can rotate with respect to the paper cassette, a media back edge guide assembly which is mounted to said media load plate in such a way that it can slide relative to the media load plate and it can be locked to the media load plate and which positions the media loaded on said media load plate according to their individual sizes, and a media size detection arrangement for detecting the media size by detection of the position of the media back edge guide assembly and producing an electrical signal indicating the position of the media back edge guide assembly.

9. An automatic paper feed device according to claim 8, wherein said detection arrangement comprises:

a slide piece which is mounted on the bottom plate of said paper cassette in such a way that it can slide in the same direction as said media back edge guide assembly, a pilot pin provided on said slide piece, said media back edge guide assembly having an engagement hole engaging said pilot pin, whereby when said media load plate is rotated toward the bottom of the paper cassette exceeding a predetermined position, the pilot pin engage the engagement hole, whereas when said media load plate is rotated away from the bottom of the paper cassette exceeding a predetermined position, the engagement is released, detection levers which are mounted on the bottom plate of said paper cassette in such a way that they can slide, each of said detection levers having a first end engageable with said slide piece as said slide piece, said detection lever being biased toward said first end by a plate spring, and microswitches detecting the position of a second end of said detection levers, whereby as said slide piece moves accompanying movement of said media back edge guide assembly, via engagement of said pilot pin and said engagement hole, said detection levers engaging the slide piece move, and said microswitches detecting the movement of said second end of said detection levers detect the position of said media back edge guide assembly, and hence the size of the media.

10. An automatic paper feed device according to claim 8, wherein said detection arrangement comprises:

a detection lever which is mounted on the bottom plate of said paper cassette in such a way that it can rotate, a pilot pin provided at a first end of said detection lever, said media back edge guide assembly having an engagement hole engaging said pilot pin, whereby when said media load plate is rotated toward the bottom of the paper cassette exceeding a predetermined position, the pilot pin engages the engagement hole, whereas when said media load plate is rotated away from the bottom of the paper cassette exceeding a predetermined position the engagement is released, and microswitches detecting the position of a second end of said detection lever, whereby as said first end of said detection lever moves in one direction, accompanying movement of said media back edge guide assembly, via engagement of said pilot pin and said engagement hole, said second end moves in the other direction, and said microswitches detecting the movement of said second end of said detection lever detect the position of said media back edge guide assembly, and hence the size of the media.

11. An automatic paper feed device as set forth in claim 10, wherein said detection arrangement further comprises:

a maintaining plate fixed to the bottom plate of the paper cassette, the maintaining plate having concave sections, said detection lever having a flat wall and a sub-lever provided with a horizontal section and a slit, and the horizontal section of the sub-lever being engageable with the concave sections of the maintaining plate, wherein when the media load plate is lowered exceeding a predetermined position, the sub-lever is pushed down by the media load plate toward the bottom of the paper cassette, so that the sub-lever is released from the concave sections of the maintaining plate.

12. An automatic paper feed device as set forth in claim 10 with the characteristic of said maintaining means being comprised of a resilient member which rotates integrally with said detection lever, and fixing member which possesses a concave section engaging said resilient member.

13. An automatic paper feed device as set forth in claim 10 with the characteristic of said detection lever being formed of a resilient member and said maintaining means being comprised of convex areas formed integrally with said detection lever and openings provided in specific positions on the bottom plate of said paper cassette.

14. An automatic paper feed device as set forth in claim 10 with the characteristic of said detection lever being formed of a magnetic material, and said maintaing means being comprised of the said detection lever and magnets disposed at specific positions on the bottom plate of said paper cassette.

* * * * *